US007639967B2

(12) United States Patent
Kamimura

(10) Patent No.: US 7,639,967 B2
(45) Date of Patent: Dec. 29, 2009

(54) PHOTOSENSITIVE-MEMBER CARTRIDGE, DEVELOPING CARTRIDGE, AND IMAGE-FORMING DEVICE INCLUDING A NON-RATTLING CONVEYING MEMBER

(75) Inventor: Naoya Kamimura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 92 days.

(21) Appl. No.: 11/500,357

(22) Filed: Aug. 8, 2006

(65) Prior Publication Data

US 2007/0048008 A1 Mar. 1, 2007

(30) Foreign Application Priority Data

Aug. 23, 2005 (JP) ..... P2005-240781

(51) Int. Cl.
*G03G 15/08* (2006.01)

(52) U.S. Cl. ..... 399/111

(58) Field of Classification Search ..... 399/111, 399/110, 116, 119

See application file for complete search history.

(56) References Cited

U.S. PATENT DOCUMENTS 5,794,101 A * 8/1998 Watanabe et al. ..... 399/103
2004/0265002 A1* 12/2004 Tsusaka ..... 399/124

FOREIGN PATENT DOCUMENTS

JP 03015864 A * 1/1991
JP 2001-75457 3/2001
JP 2004001935 A * 1/2004

* cited by examiner

*Primary Examiner*—Quana M Grainger
(74) *Attorney, Agent, or Firm*—Banner & Witcoff, Ltd.

(57) ABSTRACT

A photosensitive-member cartridge has an upper registration roller, and both ends of the upper registration roller are rotatably supported on respective side walls of a casing by roller support members. Torsion coil springs are engaged with the roller support members and the side walls, and urge the upper registration roller upward. When the photosensitive-member cartridge is alone, the upper registration roller is held at a retract position with respect to a bottom wall of the casing without rattling.

18 Claims, 30 Drawing Sheets

80
80e
80d
80f
80c
80b
80a 80
80e
80d
80c
80b 80
80c
80e
80d
80a
80b 90
90a
90b 90
90a
90b

PHOTOSENSITIVE-MEMBER CARTRIDGE, DEVELOPING CARTRIDGE, AND IMAGE-FORMING DEVICE INCLUDING A NON-RATTLING CONVEYING MEMBER

CROSS REFERENCE TO RELATED APPLICATIONS

This application claims priority from Japanese Patent Application No. 2005-240781 filed Aug. 23, 2005. The entire content of the priority application is incorporated herein by reference.

TECHNICAL FIELD

The disclosure relates to a photosensitive-member cartridge including a conveying roller for conveying a recording medium, to a developing cartridge detachably mountable on such a photosensitive-member cartridge, and to an image forming device including a detachable process cartridge having a photosensitive-member cartridge and a developing cartridge detachably mountable on the photosensitive-member cartridge.

BACKGROUND

There has been provided an image forming device that forms a visible image by supplying a developer to an electrostatic latent image formed on a photosensitive member and that transfers the visible image onto a recording medium. In this type of image forming device, in order to facilitate maintenance operation, a developing unit is configured as a developing cartridge that is detachably mounted on a main body of the image forming device. Because the time at which the photosensitive member becomes unusable due to deterioration with time differs from the time at which the developer is fully consumed, a photosensitive-member cartridge including the photosensitive member is provided separately from the developing cartridge so that these cartridges may be replaced according to their lifetime. These cartridges are attached to each other, forming a process cartridge, and the process cartridge is detachably mounted on the main body of the image forming device.

In Unexamined Patent-Application Publication No. 2001-75457, one of a pair of conveying rollers for conveying a recording medium is provided on the main body of the image forming device (hereinafter referred to as a "device-side conveying roller"), and the other one of the conveying rollers is provided on the photosensitive-member cartridge (hereinafter referred to as "cartridge-side conveying roller"). Therefore, the cartridge-side conveying roller separates from the device-side conveying roller by moving in the substantial horizontal direction when the process cartridge is detached from the main body of the image forming device.

Because the cartridge-side conveying roller needs to be properly brought into contact with the device-side conveying roller when the process cartridge is attached to the main body, the cartridge-side conveying roller is loosely supported on a cartridge casing of the photosensitive-member cartridge so as to be movable in the vertical direction with respect to the cartridge casing. For this reason, when the photosensitive-member cartridge is not mounted on the main body of the image forming device, the cartridge-side conveying roller rattles, thereby interrupting handling of the photosensitive-member cartridge. Also, when the cartridge-side conveying roller rattles, the cartridge-side conveying roller may protrude outside beyond the cartridge casing of the photosensitive-member cartridge due to its own weight.

SUMMARY

In view of the forgoing, it is an object of the invention to solve the above-mentioned problems, and also so to provide a photosensitive-member cartridge that can be easily handled when being detached from an image forming device without rattling of a cartridge-side conveying roller, a developing cartridge that can be attached to the photosensitive-member cartridge, and an image forming device that mounts the photosensitive-member cartridge and the developing cartridge.

In order to attain the above and other objects, according to some aspects of the invention, there is provided a photosensitive-member cartridge attachable to an image forming device including a device-side roller. The photosensitive-member cartridge includes a photosensitive member on which an electrostatic latent image is formed, a casing that houses the photosensitive member, a conveying member, and a holding member. A developing cartridge including a developing member that develops the electrostatic latent image into a visible image is detachably attachable to the casing. The conveying member includes a cartridge-side roller supported on the casing so as to be movable relative to the casing. The cartridge-side roller conveys a recording medium in cooperation with the device-side roller. The holding member is disposed between the casing and the conveying member and holds the conveying member, wherein the holding member prevents the conveying member from rattling relative to the casing.

There is also provided a developing cartridge detachably attachable to a photosensitive-member cartridge. The photosensitive-member cartridge includes a photosensitive member on which an electrostatic latent image is formed, a casing that houses the photosensitive member, a conveying member including a cartridge-side roller that conveys a recording medium in cooperation with a device-side roller of an image-forming device and a support member that rotatably supports the cartridge-side roller, and a holding member that holds the conveying member. The developing cartridge includes a developing member that develops the electrostatic latent image formed on the photosensitive member of the photosensitive-member cartridge, and a pressing member that presses the conveying member of the photosensitive-member cartridge against holding force of the holding member of the photosensitive-member cartridge when the developing cartridge is attached to the photosensitive-member cartridge.

There is also provided an image-forming device including a device-side roller, a housing that supports the device-side roller, a photosensitive-member cartridge, a developing cartridge, and a resilient member. The photosensitive-member cartridge is detachably supported on the housing, and includes a photosensitive member on which an electrostatic latent image is formed, a cartridge casing that houses the photosensitive member, a conveying member, and an urging member. The conveying member includes a cartridge-side roller and a support member that rotatably supports the cartridge-side roller. The cartridge-side roller conveys a recording medium in cooperation with the device-side roller. The urging member urges the cartridge-side roller toward a retract position. The developing cartridge is detachably attached to the photosensitive-member cartridge, and includes a developing member that develops the electrostatic latent image formed on the photosensitive member into a visible image, and a pressing member that presses the cartridge-side roller against urging force of the urging member when the developing cartridge is attached to the photosensitive-member cartridge and the photosensitive-member cartridge is detached from the housing. The resilient member urges the cartridge-side roller against the device-side roller when the photosensitive-member cartridge and the developing cartridge are mounted to the housing. The urging force of the resilient member is greater than the urging force of the urging member.

BRIEF DESCRIPTION OF THE DRAWINGS

Illustrative aspects in accordance with the invention will be described in detail with reference to the following figures wherein:

FIG. 3(*b*) is a front view of the roller support member in FIG. 3(*a*);

FIG. 3(*c*) is a side view of the roller support member;

FIG. 3(*d*) is a side view of a torsion coil spring that is attached to the roller support member;

FIG. 3(*e*) is a perspective view of the torsion coil spring in FIG. 3(*d*);

DETAILED DESCRIPTION

Next, a laser printer according to some aspects of the invention will be described with reference to the accompanying drawings. Note that in the following description, the expressions "front", "rear", "left", "right", "above", and "below" are used to define the various parts when the laser printer is disposed in an orientation in which it is intended to be used.

Figure 1:
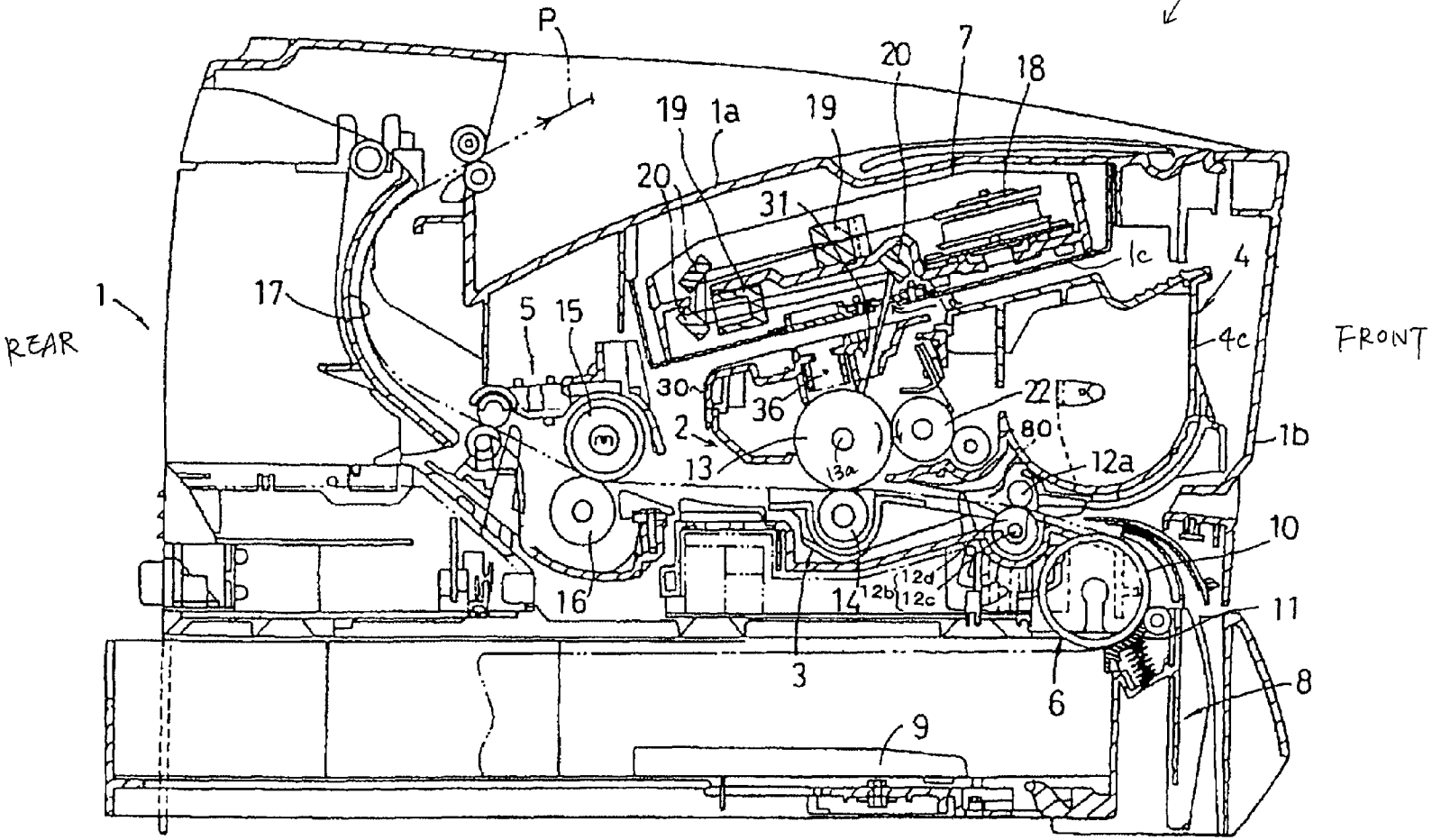
FIG. 1 is a schematic side sectional view of a laser printer according to illustrative aspects of the invention.

As shown in FIG. 1, a laser printer LP according to illustrative aspects of the invention includes a housing 1 and a process cartridge 2 accommodated in a substantially center section of the housing 1. The process cartridge 2 is detachable from the housing 1 through the front face of the housing 1. The process cartridge 2 includes a photosensitive-member cartridge 3 and a developing cartridge 4 detachably mounted to the photosensitive-member cartridge 3.

The photosensitive-member cartridge 3 includes a photosensitive drum 13, a transfer roller 14, a charger 36, and a casing 30. The photosensitive drum 13 has a shaft 13*a* and a photosensitive surface formed of an organic photosensitive member or the like, and is disposed so as to be freely rotatable. The transfer roller 14 is disposed below the photosensitive drum 13 so as to rotate while contacting the lower surface of the photosensitive drum 13. The charger 36 is disposed above the photosensitive drum 13 for charging the photosensitive surface of the photosensitive drum 13. The charger 36 is a Scorotron charger, for example. The casing 30 is formed with a light inlet port 31 elongated along an axial direction of the photosensitive drum 13 at a position adjacent to the charger 36.

The developing cartridge 4 includes a casing 4*c* that houses toner as developer and a developing roller 22. The developing roller 22 is rotatably disposed in confrontation with the photosensitive drum 13. Toner supplied onto the developing roller 22 forms a thin layer on the surface of the developing roller 22, and rotation of the developing roller 22 conveys the toner to a position where the developing roller 22 faces the photosensitive drum 13.

The laser printer LP further includes a fixing unit 5, a discharge sheet tray 1*a*, a laser scanning unit 7, and a sheet feeder 6.

The fixing unit 5 is disposed downstream of the process cartridge 2 in a conveying direction of paper P, and includes a heat roller 15 and a pressure roller 16.

The discharge sheet tray 1*a* is made of synthetic resin and is provided to the upper section of the housing 1 for receiving paper P discharged from the fixing unit 5. The discharge sheet tray 1*a* also serves as a cover.

The laser scanning unit 7 is supported on a frame 1*c* at a position below the discharge sheet tray 1*a*, and includes a laser light-emitting portion (not shown), a polygon mirror 18, a lens 19, a plurality of reflecting mirrors 20 and the like.

The sheet feeder 6 is disposed below the process cartridge 2, and includes a sheet cassette 8, a support plate 9, a sheet feed roller 10, and a separator pad 11. The sheet cassette 8 is attachable to a lower portion of the housing 1 by moving the sheet cassette 8 from through the front face of the housing 1. The support plate 9 supports a stack of paper P inside the sheet cassette 8. The sheet feed roller 10 picks up paper P from the support plate 9, and the separator pad 11 separates the paper P one sheet at a time.

The laser printer LP further includes a pair of registration rollers 12*a*, 12*b* disposed downstream of the sheet feeder 6 in the sheet feed direction.

The registration rollers 12*a*, 12*b* are for conveying the paper P supplied from the sheet feeder 6 to a contact portion between the photosensitive drum 13 and the transfer roller 14 at precise timing.

The upper registration roller 12*a* is made of metal such as plated iron or stainless steel and has a length longer than the width of the paper P. The lower registration roller 12*b* includes a shaft 12*c* covered with an elastic layer 12*d*. The shaft 12*c* is made of metal such as plated iron or stainless steel, and the elastic layer 12*d* is made of urethane rubber or the like. The shaft 12*c* is rotatably supported by the housing 1. Although not shown in the drawings, the shaft 12*c* is coupled to a driving source, such as a motor, through a gear or the like, and the timing of start rotating and speed of the rotation of the shaft 12*c* is controlled by a control unit.

In the illustrative aspects, the upper registration roller 12*a* is provided to the photosensitive-member cartridge 3, and the lower registration roller 12*b* is provided to a main body of the laser printer LP. Thus, the process cartridge 2, that is, the photosensitive-member cartridge 3 with the developing cartridge 4 attached thereto can be easily taken out of the main body of the laser printer LP from the front face side of the laser printer LP.

With this configuration, when print data is transmitted to the laser printer LP from an eternal apparatus, for example, a personal computer, a paper P is separated from a stack of sheets P on the support plate 9 one sheet at a time by the separator pad 11 as the sheet feed roller 10 rotates. The separated paper P is conveyed to the contact portion between the photosensitive drum 13 and the transfer roller 14 via the pair of registration rollers 12*a*, 12*b*.

On the other hand, the surface of the photosensitive drum 13 is uniformly charged by the charger 36. A laser beam is emitted from the laser scanning unit 7 through a light-emitting hole 1*d* formed on a lower portion of the frame 1*c*. The laser beam travels through the light inlet port 31 of the casing 30 and scans an upper peripheral surface portion of the rotating photosensitive drum 13, thereby forming an electrostatic latent image thereon.

Rotation of the developing roller 22 conveys the thin layer of the toner formed on the developing roller 22 to an area opposed to the electrostatic latent image. As a result, the electrostatic latent image is developed into a visible image with the toner, and the visible toner image is transferred onto the paper P at a transfer position between the transfer roller 14 and the photosensitive drum 13. After the transfer operation, the toner image is thermally fixed onto the paper P as the paper P is conveyed between the heat roller 15 and the pressure roller 16 in the fixing unit 5. Thereafter, the paper P is discharged onto the discharge sheet tray 1*a* through a sheet discharge path 17.

When the toner is consumed with such printing operation, causing a need to supply the toner, first the process cartridge 2 is pulled out of the housing 1 through the front surface of the housing 1, and the developing cartridge 4 is removed from the process cartridge 2. Then, a new developing cartridge 4 is attached to the process cartridge 2, and the process cartridge 2 is mounted on the housing 1 through the front surface of the housing 1. In this manner, a user can easily supply the toner without getting his/her hand soiled. Also, when the photosensitive drum 13 deteriorates, the process cartridge 2 is removed from the housing 1 in the same manner, and the photosensitive-member cartridge 3 is replaced with a new one. After that, the process cartridge 2 is attached to the housing 1 of the laser printer LP.

Next, the photosensitive-member cartridge 3 and the developing cartridge 4 will be described further in detail while reference to FIGS. 2 to 9.

Figure 2:
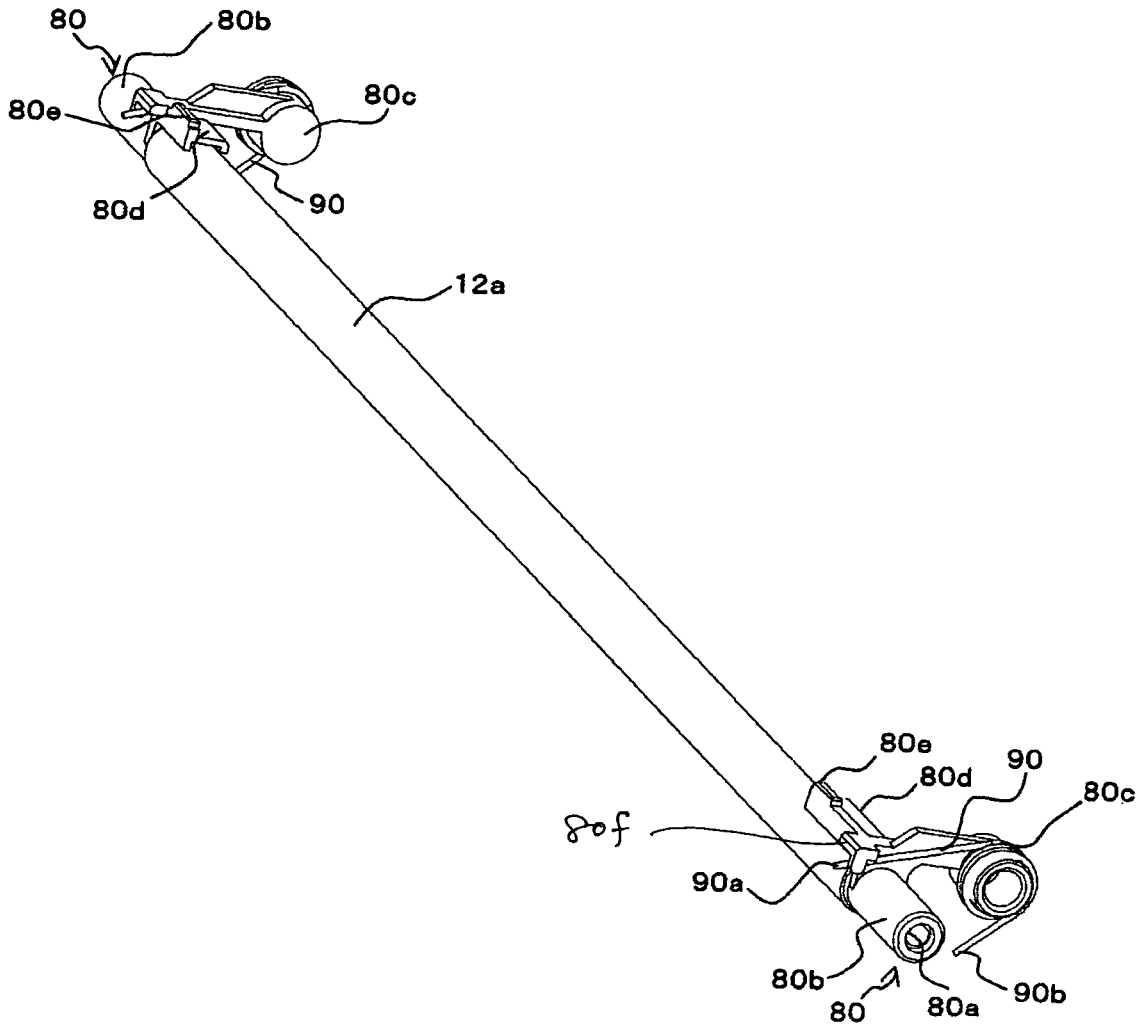
FIG. 2 is a perspective view of an upper registration roller attached with roller support members of the laser printer in FIG. 1.
Figures 3A, 3B, 3C, 3D, 3E:
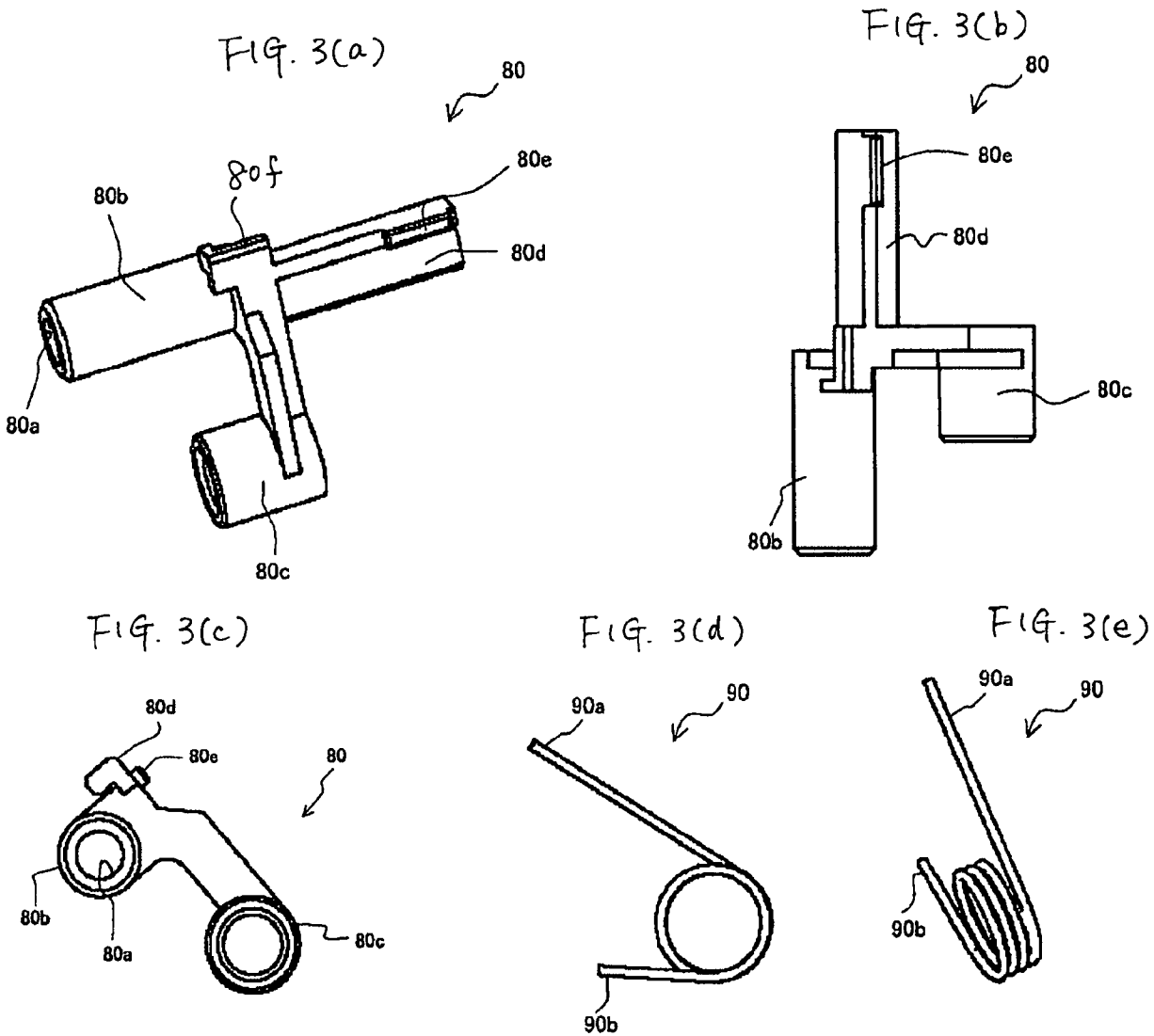
FIG. 3(*a*) is a perspective view of one of the roller support members in FIG. 2.

As shown in FIG. 2, roller support members 80 made of resin are attached to the both ends of the upper registration roller 12*a*. As shown in FIGS. 3(*a*) to 3(*c*), each roller support member 80 integrally includes a cylindrical member 80*b* formed with an inserting hole 80*a*, a wall-side cylindrical member 80*c*, a holding member 80*d*, an engaging member 80*e* formed on the holding member 80*d*, and a spring supporting member 80*f*.

Figure 6:
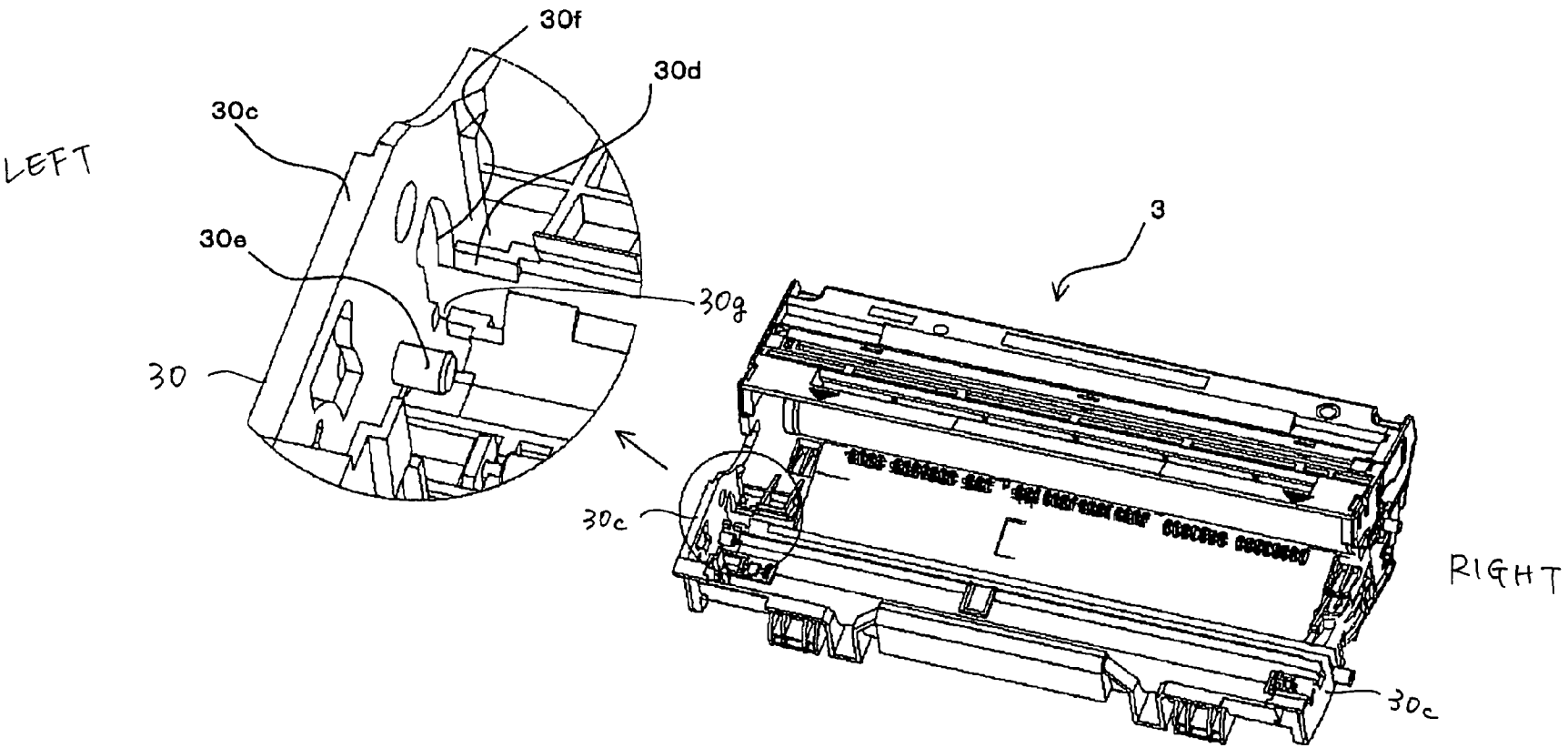
FIG. 6 is a perspective view of the photosensitive-member cartridge with the upper registration roller removed therefrom, from a point diagonally above and frontward and rightward thereof.

As shown in FIG. 6, the casing 30 of the photosensitive-member cartridge 3 has a pair of right and left side walls 30*c* and a bottom wall 30*d*. A protrusion 30*e* is formed on each of the side walls 30*c*. The wall-side cylindrical members 80*c* of the roller support members 80 are fitted to the corresponding protrusions 30*e*. The side walls 30*c* are formed with respective notch portions 30*f*, and the cylindrical members 80*b* of the roller support members 80 are fitted to the corresponding notch portions 30*f*.

Figure 4:
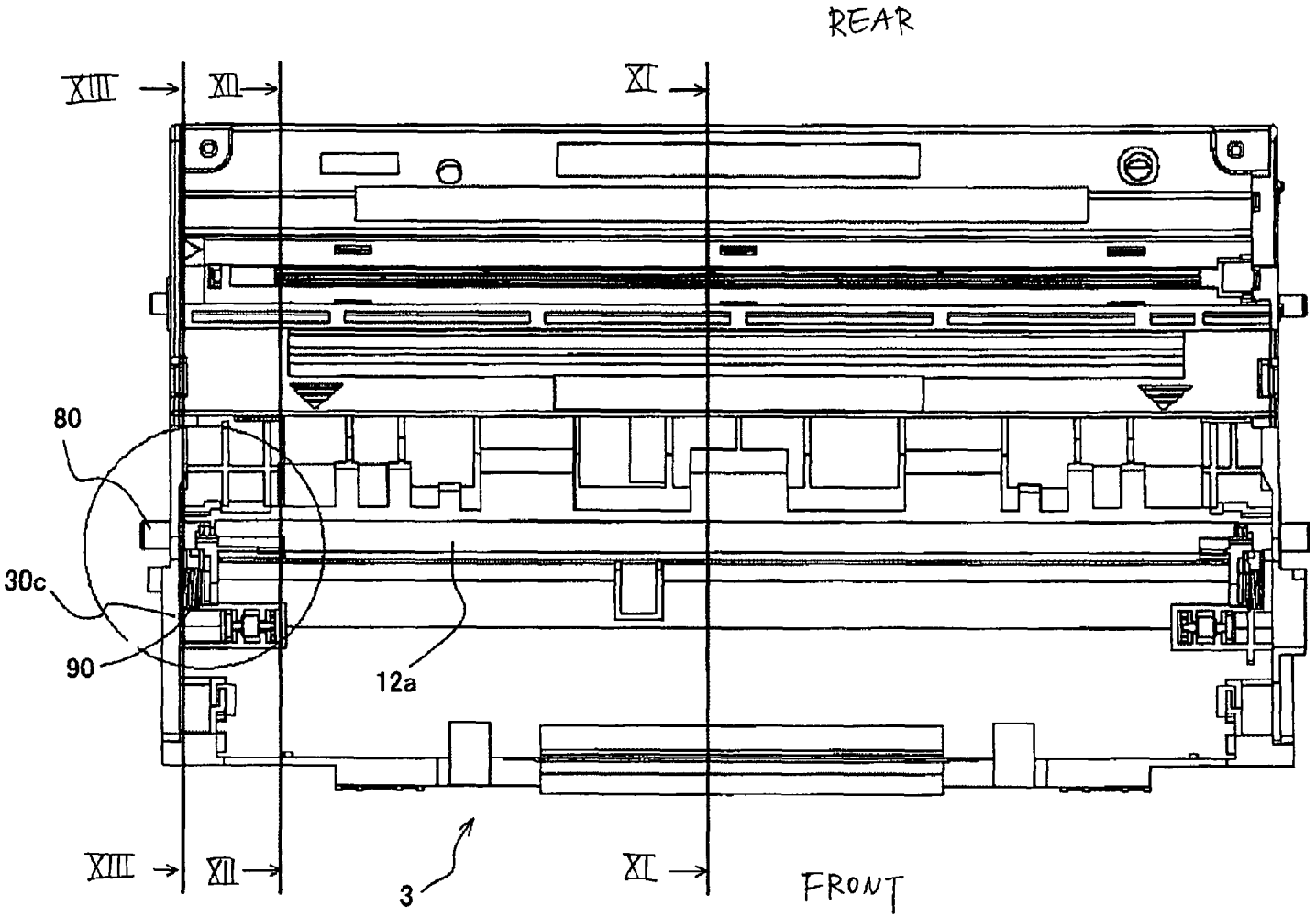
FIG. 4 is a top view showing a photosensitive-member cartridge of the laser printer in FIG. 1.
Figure 5:
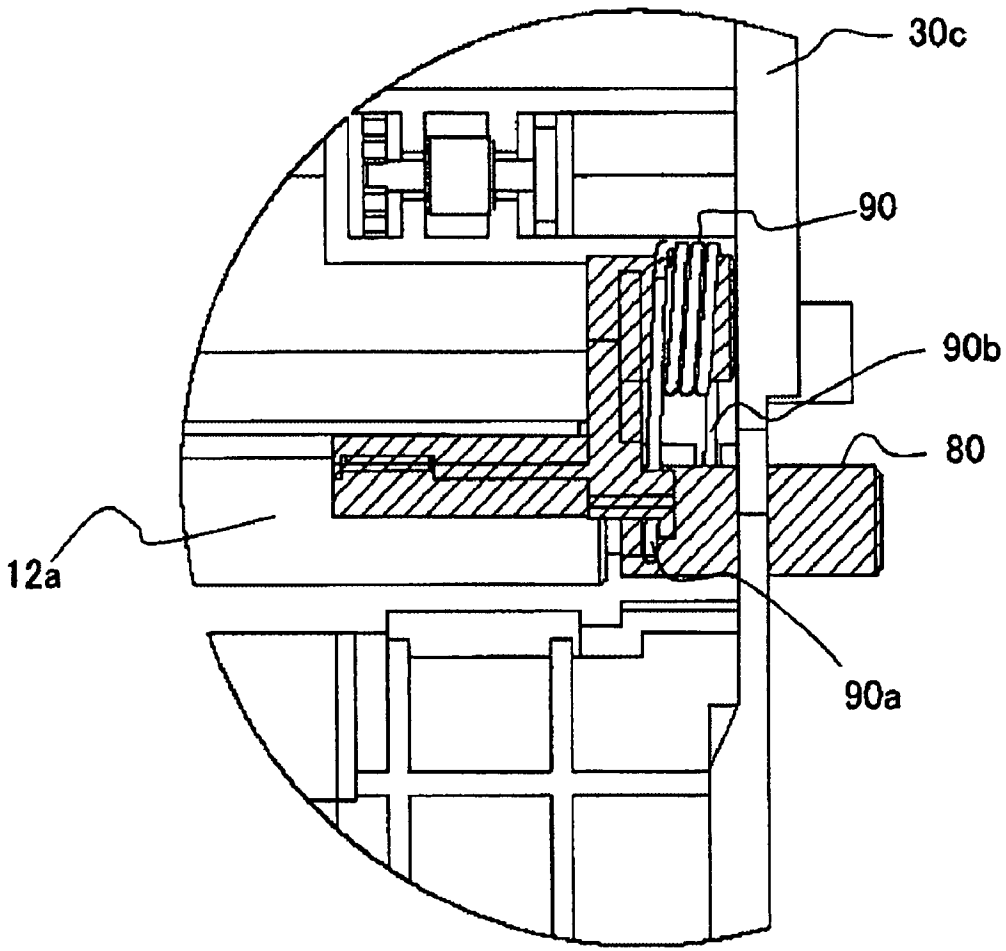
FIG. 5 is an enlarged view of an encircled area in FIG. 4, wherein shaded areas are the roller support members.

With this configuration, the upper registration roller 12*a* is supported on the casing 30 as shown in FIGS. 4 and 5 and so as to be movable with respect to the casing 30 along the notch portions 30*f* shown in FIG. 6 in the vertical direction.

Figure 7:
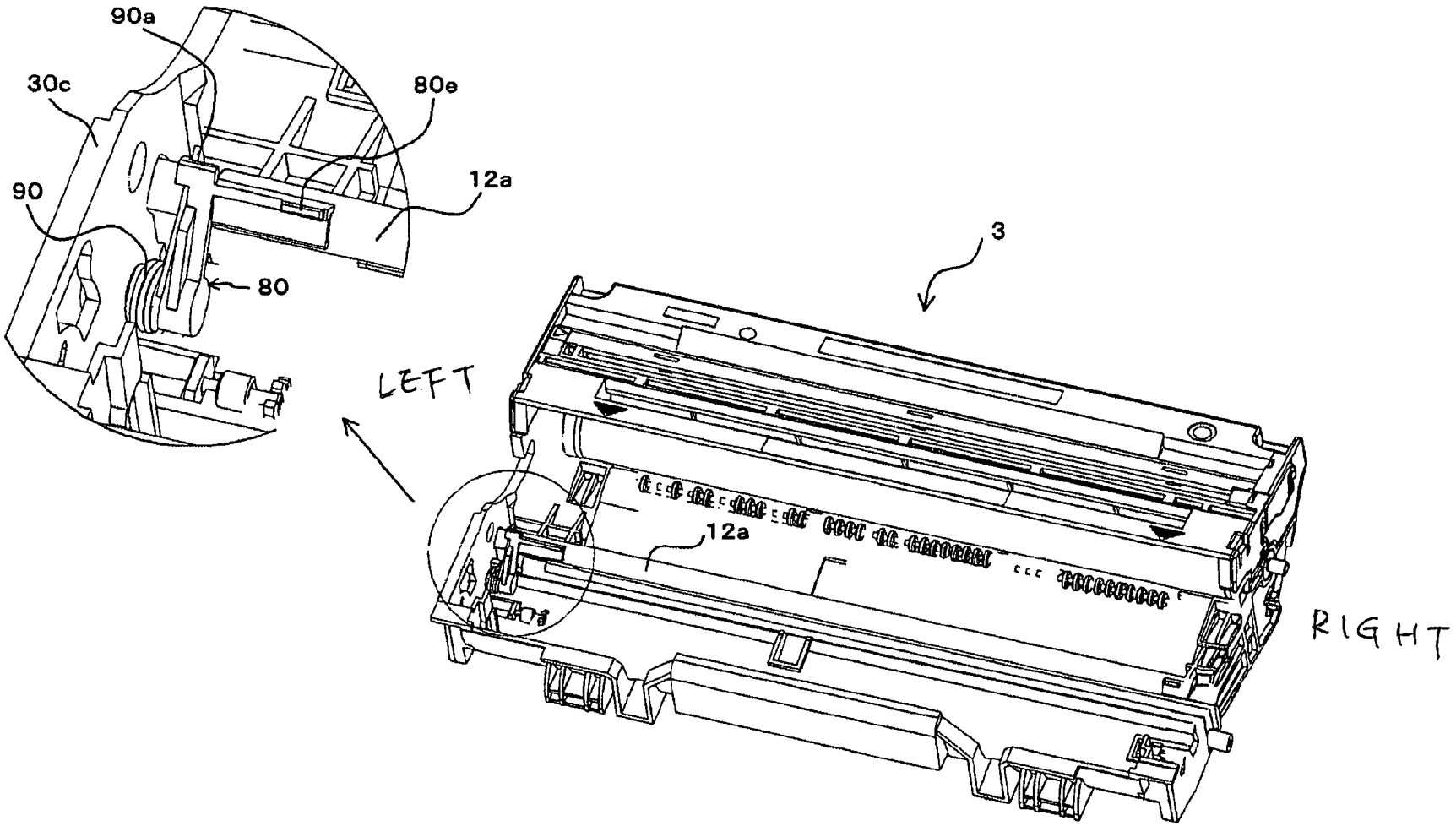
FIG. 7 is a perspective view of the photosensitive-member cartridge with the upper registration roller attached thereto, from a point diagonally above and frontward and rightward thereof.
Figure 8:
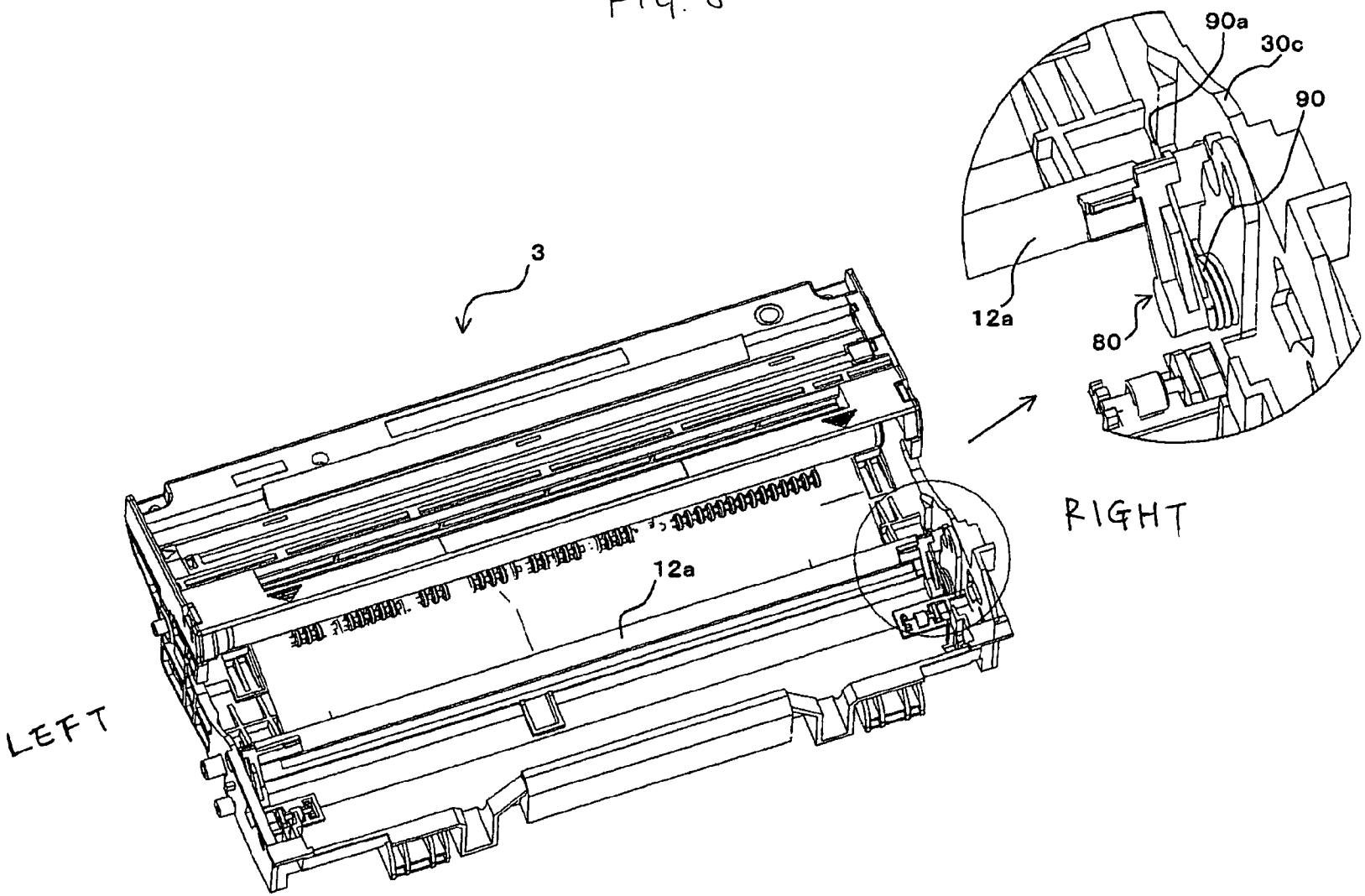
FIG. 8 is a perspective view of the photosensitive-member cartridge with the upper registration roller attached thereto, from a point diagonally above and frontward and leftward thereof.
Figure 9:
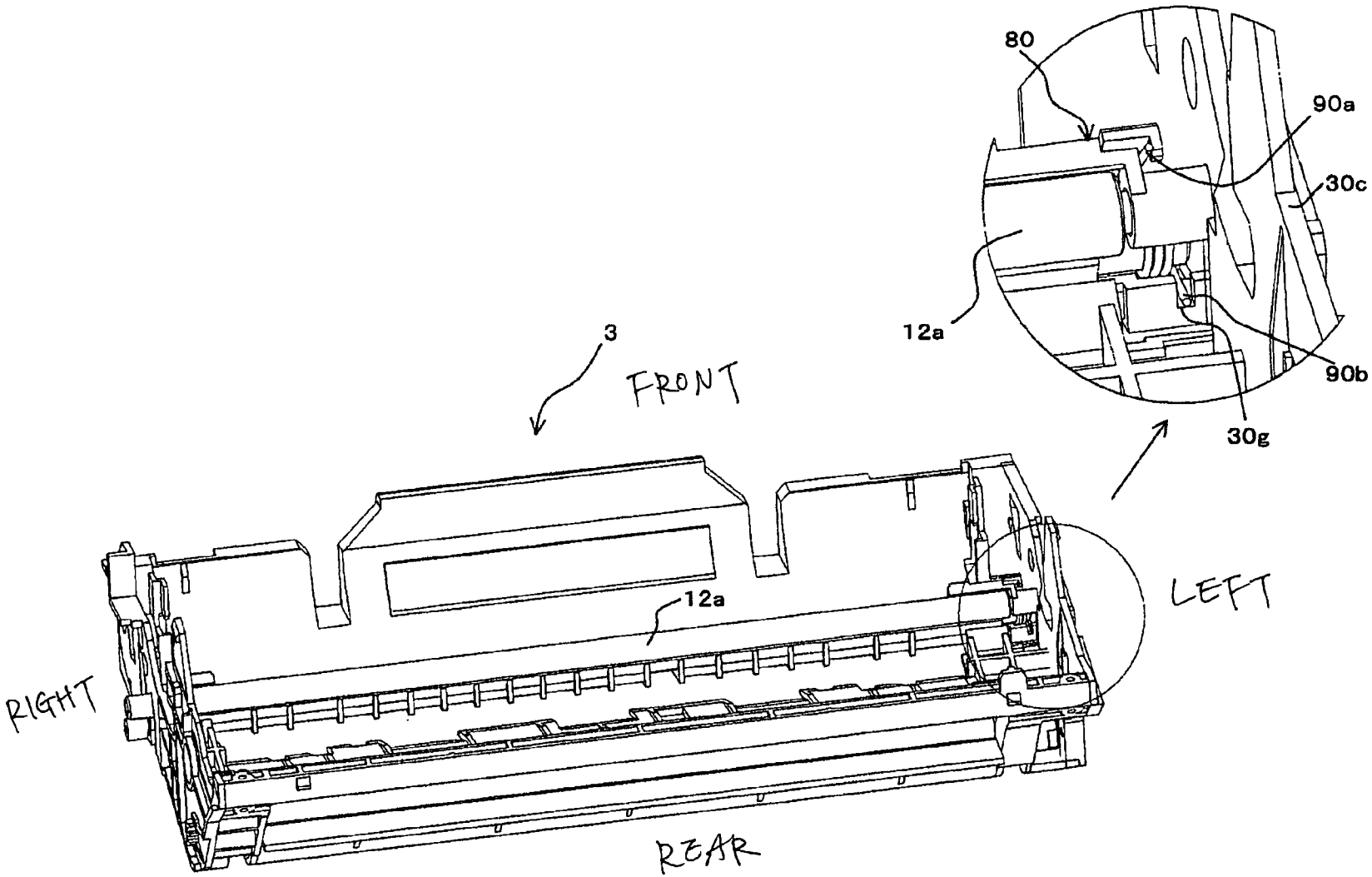
FIG. 9 is a perspective view of the photosensitive-member cartridge with the upper registration roller attached thereto and with a photosensitive drum and an upper frame being removed therefrom, from a point diagonally below and rearward and rightward thereof.

Torsion coil springs 90 shown in FIGS. 3(*d*) and 3(*e*) are attached to the roller support members 80. Specifically, as shown in FIGS. 2, 7 and 8, one end 90*a* of each of the torsion coil springs 90 is supported on the corresponding roller support member 80 at the spring supporting member 80*f*, and as shown in FIG. 9, the other end 90*b* is supported on the casing 30 at a recessed part 30*g* formed in the side wall 30*c*. The torsion coil springs 90 urge the upper registration roller 12*a* toward the inside of the casing 30 through the roller support members 80, that is, upwards relative to the bottom wall 30*d*.

Figure 10:
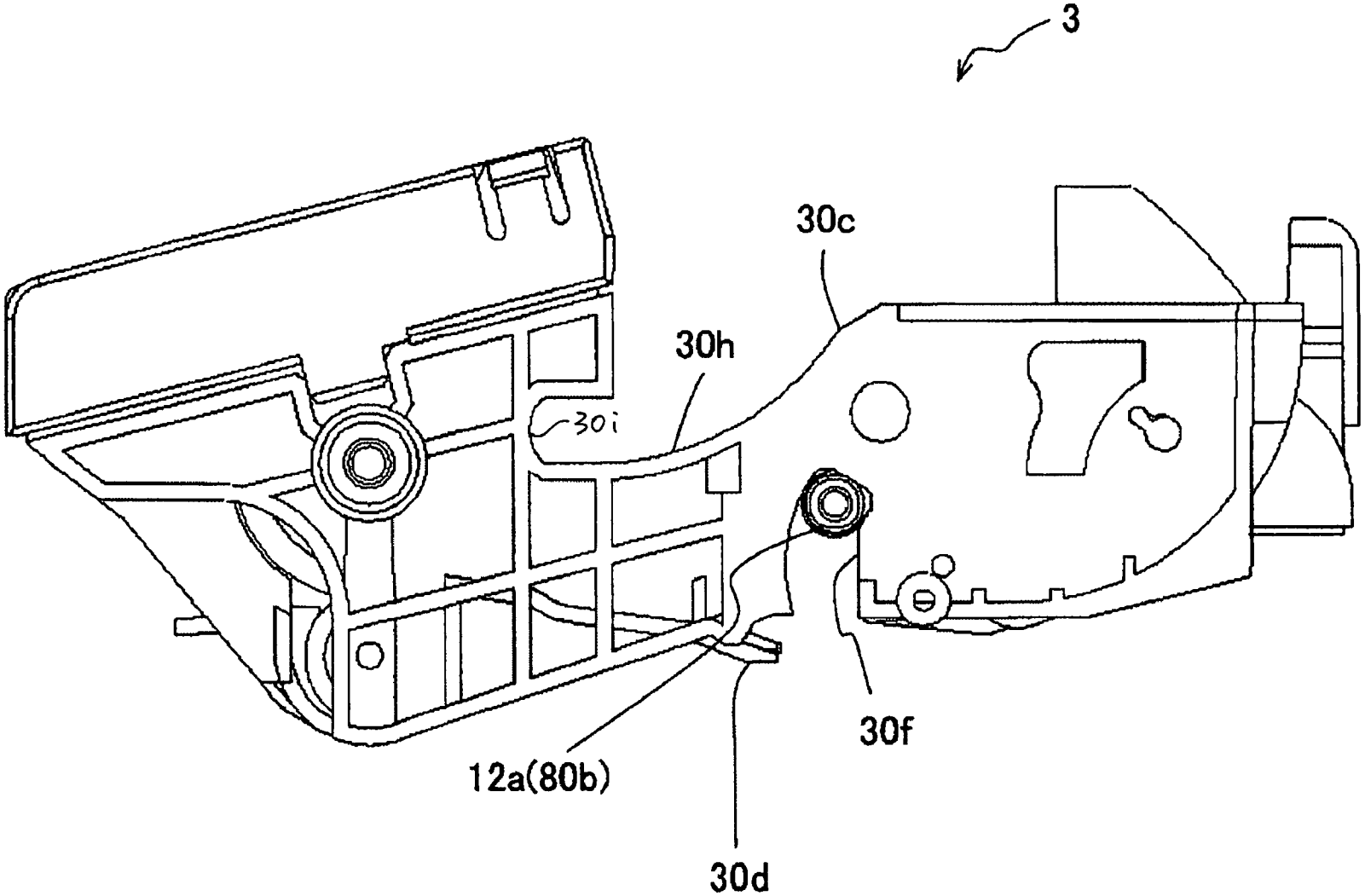
FIG. 10 is a side view of the photosensitive-member cartridge.
Figure 11:
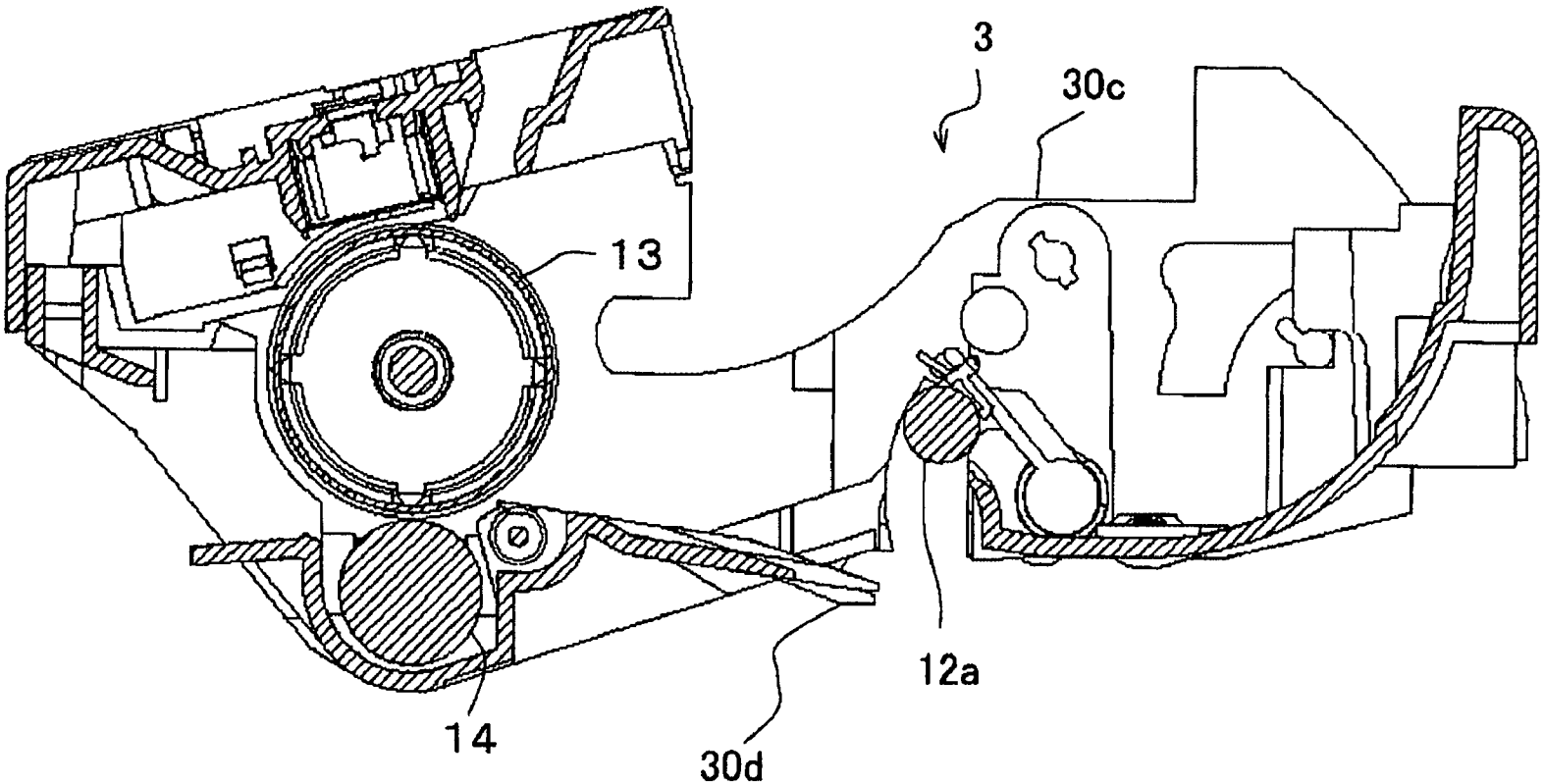
FIG. 11 is a cross-sectional view of the photosensitive-member cartridge taken along a XI-XI line in FIG. 4.
Figure 12:
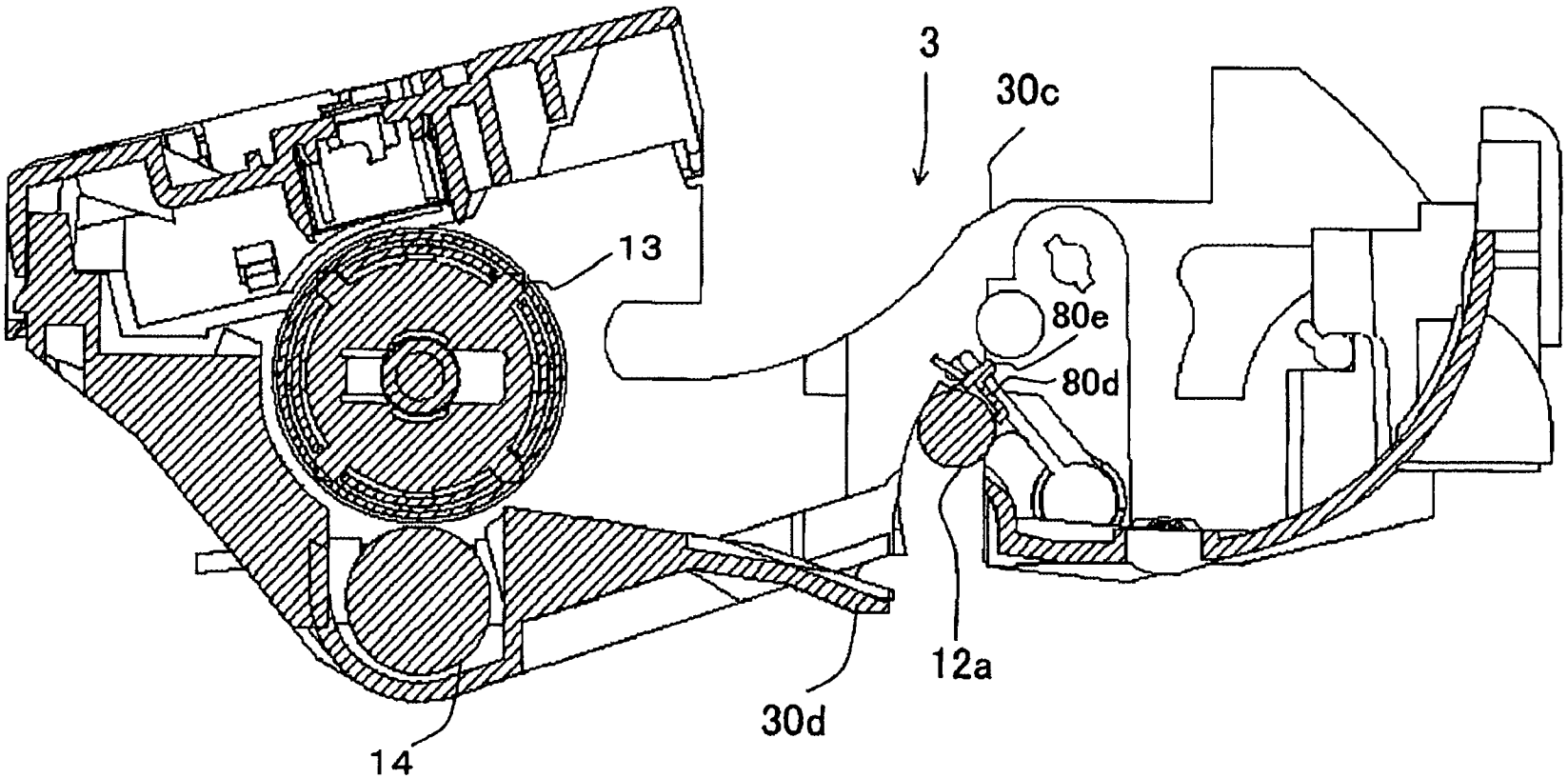
FIG. 12 is a cross-sectional view of the photosensitive-member cartridge taken along a XII-XII line in FIG. 4.
Figure 13:
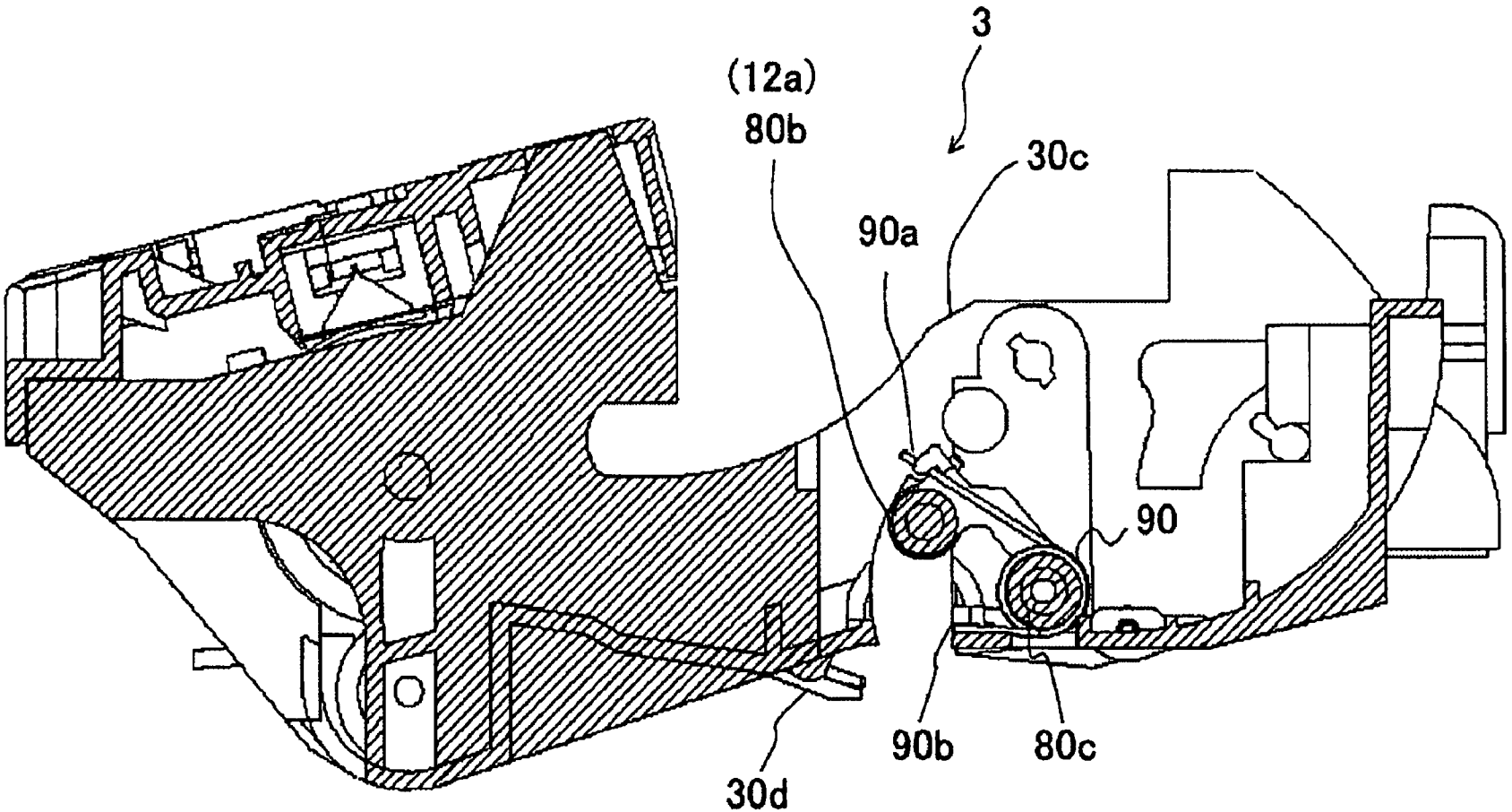
FIG. 13 is a cross-sectional view of the photosensitive-member cartridge taken along a XIII-XIII line in FIG. 4.

With this configuration, when the photosensitive-member cartridge 3 is alone (i.e., when the photosensitive member cartridge 3 is removed from the housing 1, and the developing cartridge 4 is not attached to the photosensitive member cartridge 3), as shown in FIG. 10, the upper registration roller 12*a* is held at a retract position where the cylindrical members 80*b* of the roller support members 80 abut against the upper edges of the notch portions 30*f* due to urging force of the torsion coil springs 90. Therefore, the upper registration roller 12*a* does not rattle or protrude beyond the bottom surface of the casing 30, and thus the upper registration roller 12*a* does not become an obstacle when a user handles the photosensitive-member cartridge 3.

Also, it is possible to easily adjust the retract position (how much the upper registration roller 12*a* is retracted upward in the casing 30) by modifying the depth of the notch portions 30*f* in the side walls 30*c*.

Figure 14:
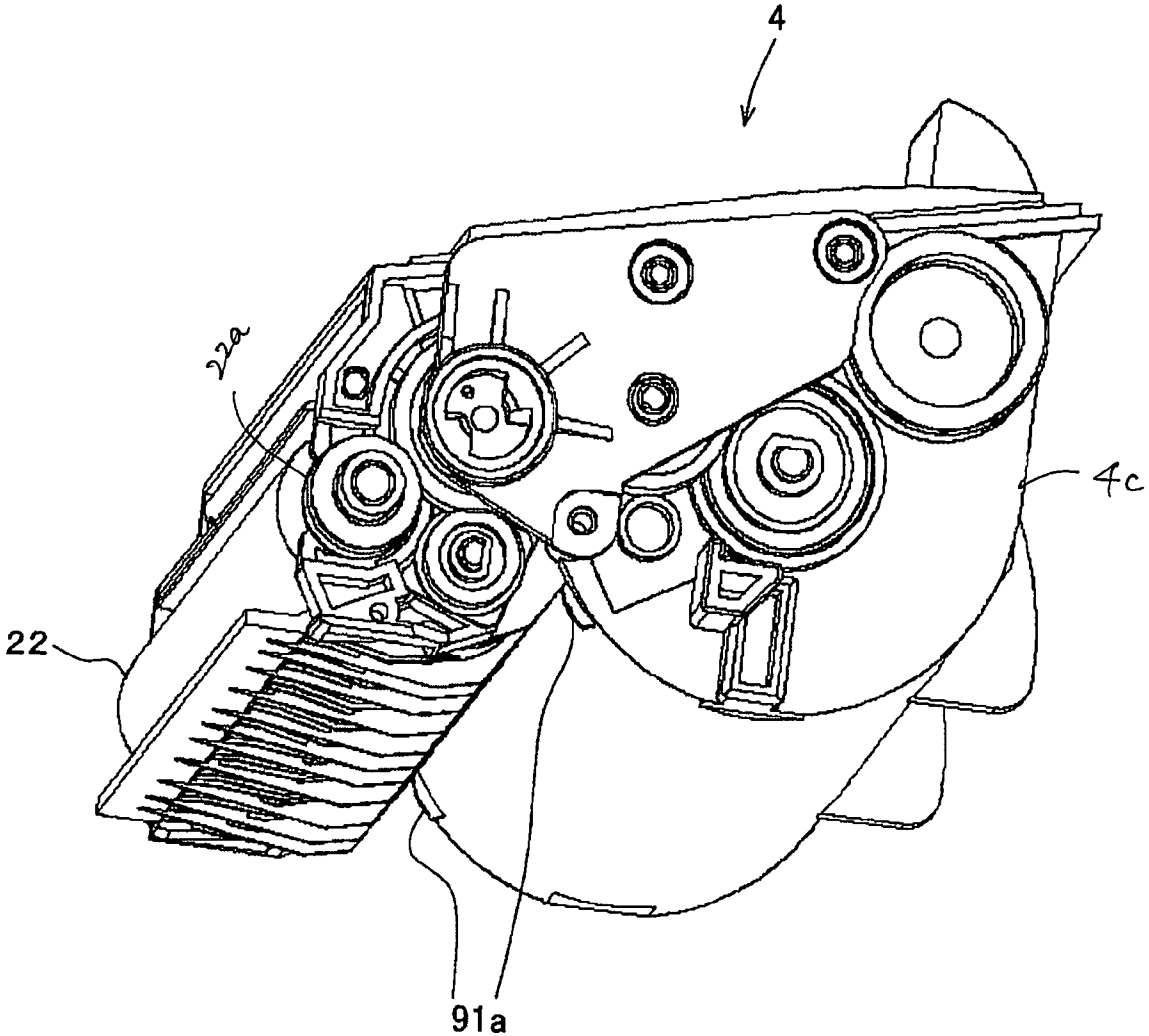
FIG. 14 is a perspective view of a developing cartridge according to the illustrative aspects of the invention from a point diagonally below.
Figure 15:
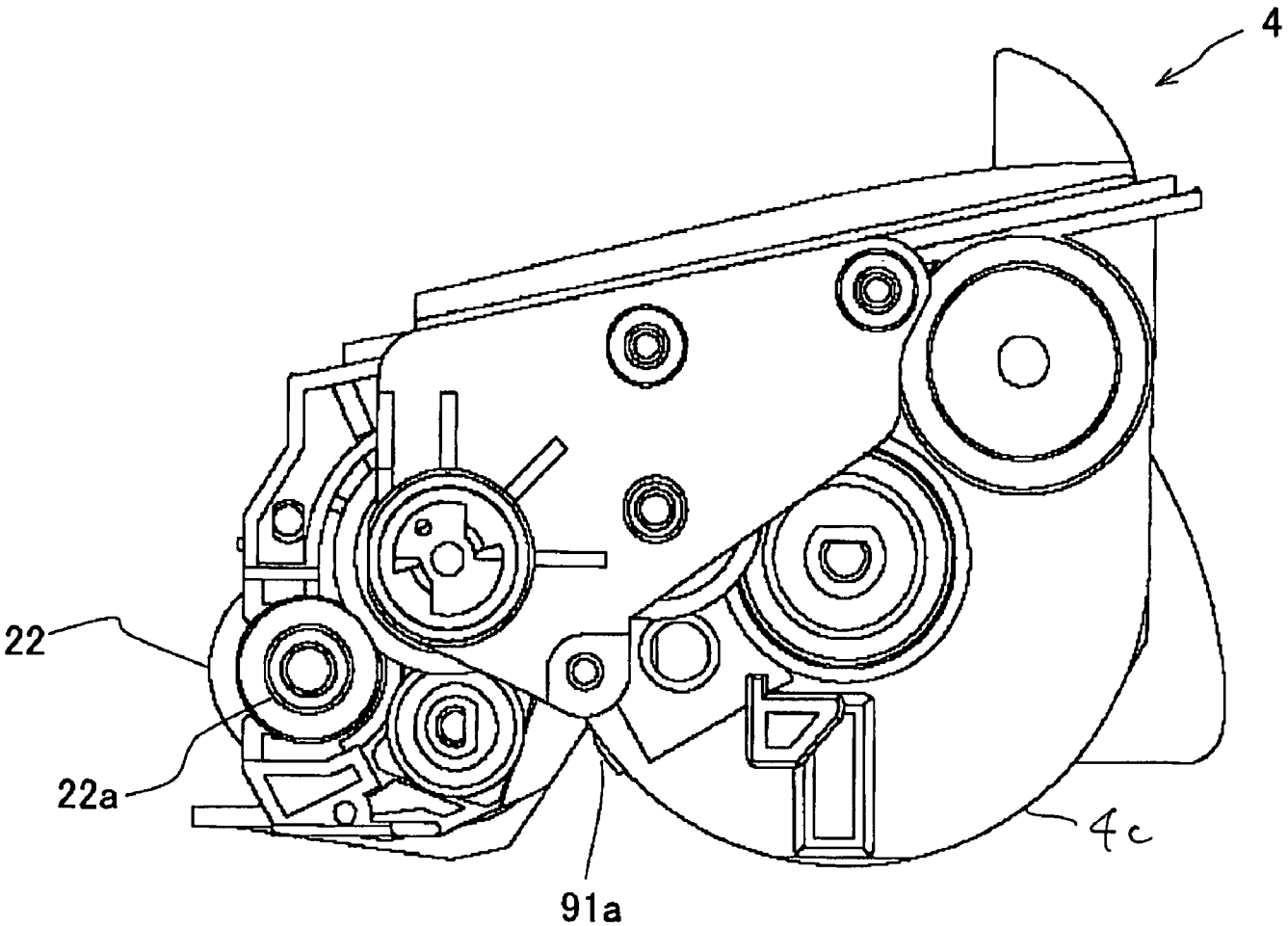
FIG. 15 is a side view of the developing cartridge in FIG. 14.
Figure 16:
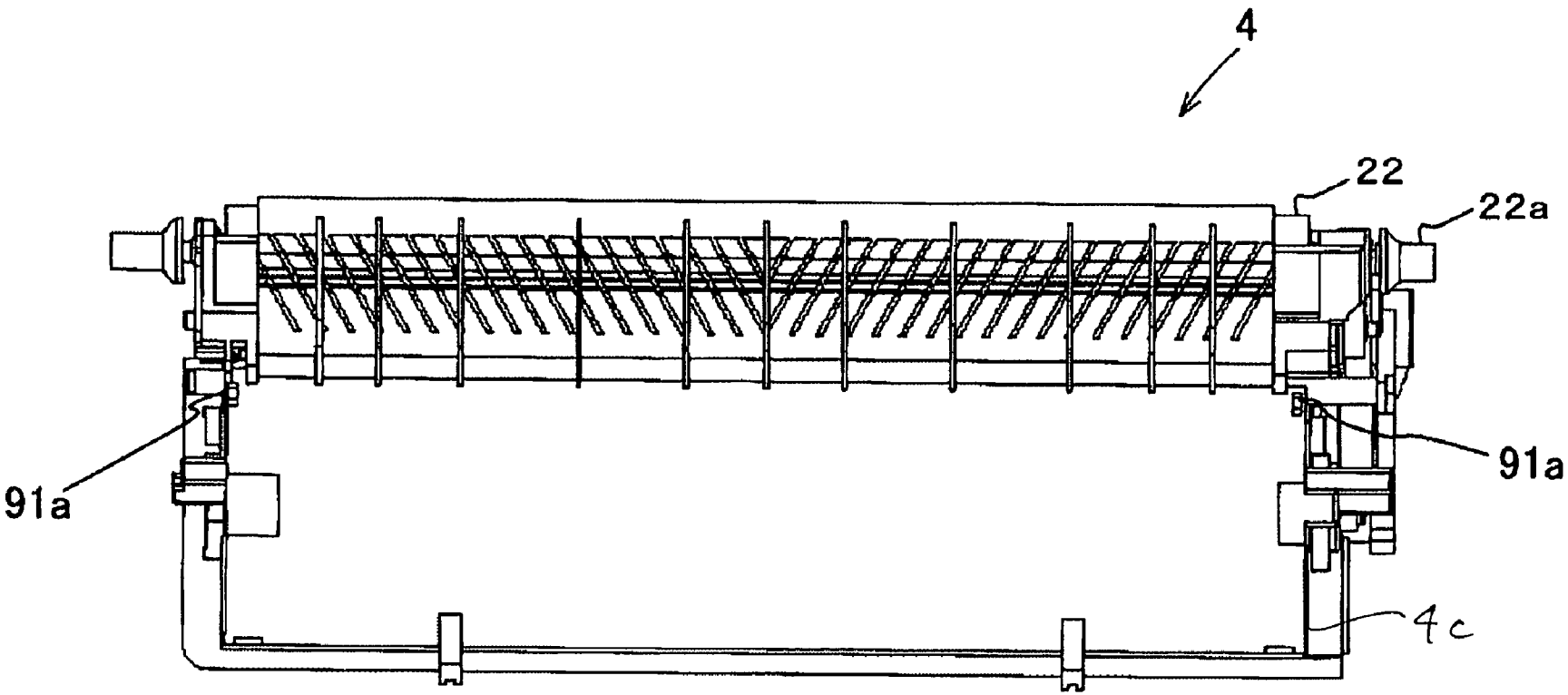
FIG. 16 is a bottom view of the developing cartridge in FIG. 14.

As shown in FIGS. 14 to 16, the developing roller 22 has bearings 22*a* at both ends, and pressing parts 91*a* protrude from both ends of the bottom surface of the casing 4*c* of the developing cartridge 4.

Figure 17:
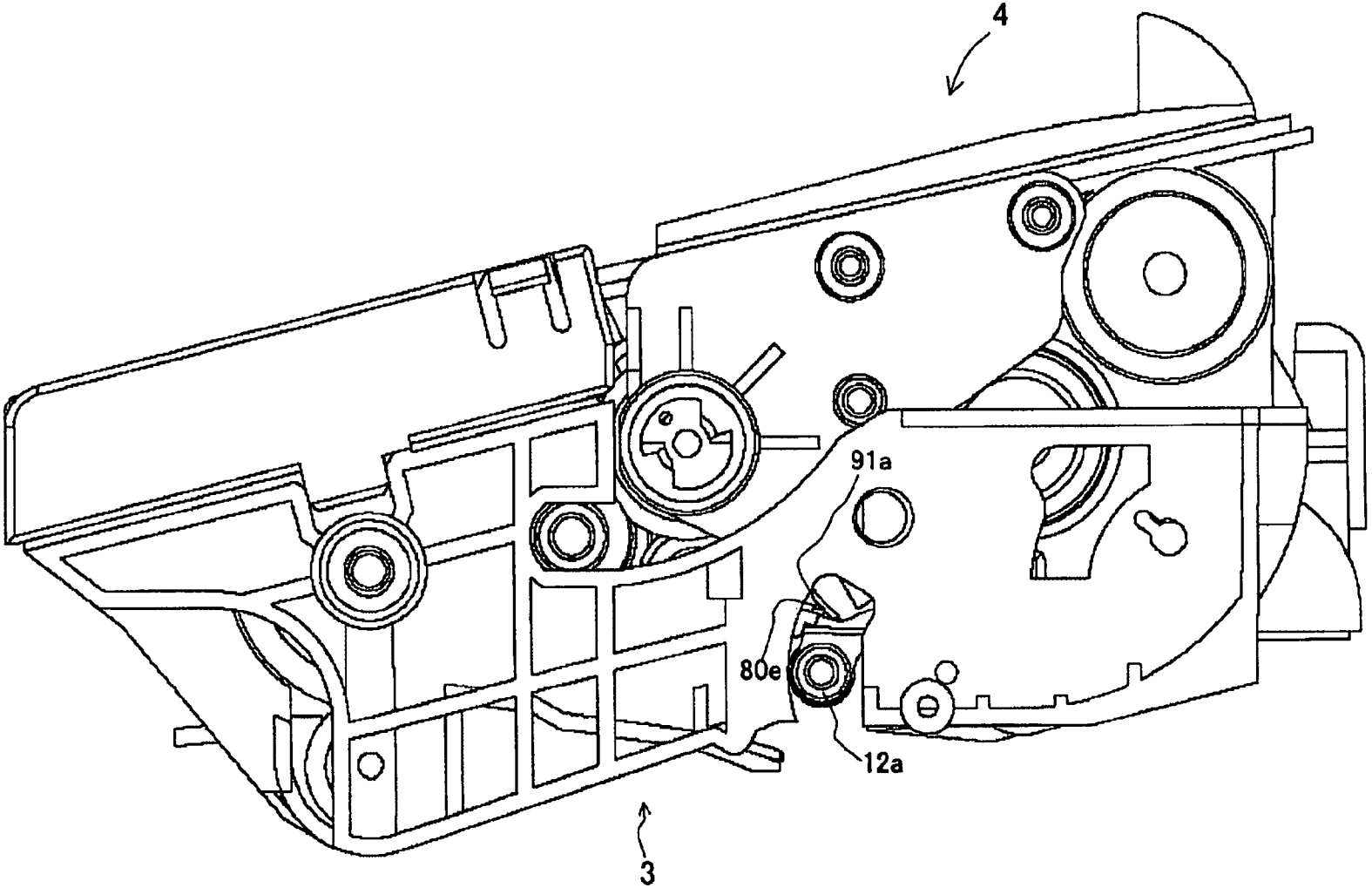
FIG. 17 is a side view of the developing cartridge completely attached to the photosensitive-member cartridge.

As shown in FIG. 10, guiding parts 30*h* are formed in the side walls 30*c* of the photosensitive member cartridge 3. When a user attaches the developing cartridge 4 to the photosensitive-member cartridge 3, the bearings 22*a* of the developing roller 22 (FIG. 15) move along the guiding parts 30*h*. In the course of attachment, the pressing parts 91*a* formed on the bottom surface of the developing cartridge 4 come into contact with the engaging members 80*e* of the roller support members 80 attached to the both ends of the upper registration roller 12*a* at the retract position, and then press the engaging members 80*e* downward. As a result, against the upward urging force of the torsion coil springs 90, the upper registration roller 12*a* supported by the roller support members 80 is also pressed downward and moved to a position below the retract position. When the bearings 22*a* reaches deepest positions 30*i* of the guiding parts 30*h* and the developing cartridge 4 is completely attached to the photosensitive-member cartridge 3, the pressing parts 91*a* do not further press the developing cartridge 4, and as shown in FIG. 17, the upper registration roller 12*a* is held at a working position below the retract position without rattling. Then, the developing cartridge 4 is locked relative to the photosensitive-member cartridge 3 by a locking member not shown.

In this state, the upper registration roller 12*a* cannot move upward due to the presence of the developing cartridge 4, while the upper registration roller 12*a* can move downward against the urging force of the torsion coil spring 90 when downward force is applied to the cylindrical members 80*b* of the roller support members 80 protruding outward from the side walls 30*c* through the notch portions 30*f*.

As described above, in the illustrative aspects, only by the simple operation of attaching the developing cartridge 4 to the photosensitive-member cartridge 3, the upper registration roller 12*a* can be pressed downward and moved to the working position. Also, since the upper registration roller 12*a* does not rattle even when handling the photosensitive-member cartridge 3 attached with the developing cartridge 4, the handling of the photosensitive-member cartridge 3 is easy.

Next, description will be provided for an operation of attaching the process cartridge 2 (the photosensitive member cartridge 3 and the developing cartridge 4 attached to the photosensitive-member cartridge 3) to the housing 1, and for a positioning mechanism for positioning the upper registration roller 12*a*, with reference to FIGS. 18 to 23.

The attachment and detachment of the process cartridge 2 is performed in the state where a front cover 1*b* (FIG. 1) of the housing 1 is pivoted downward to widely open.

Figure 18:
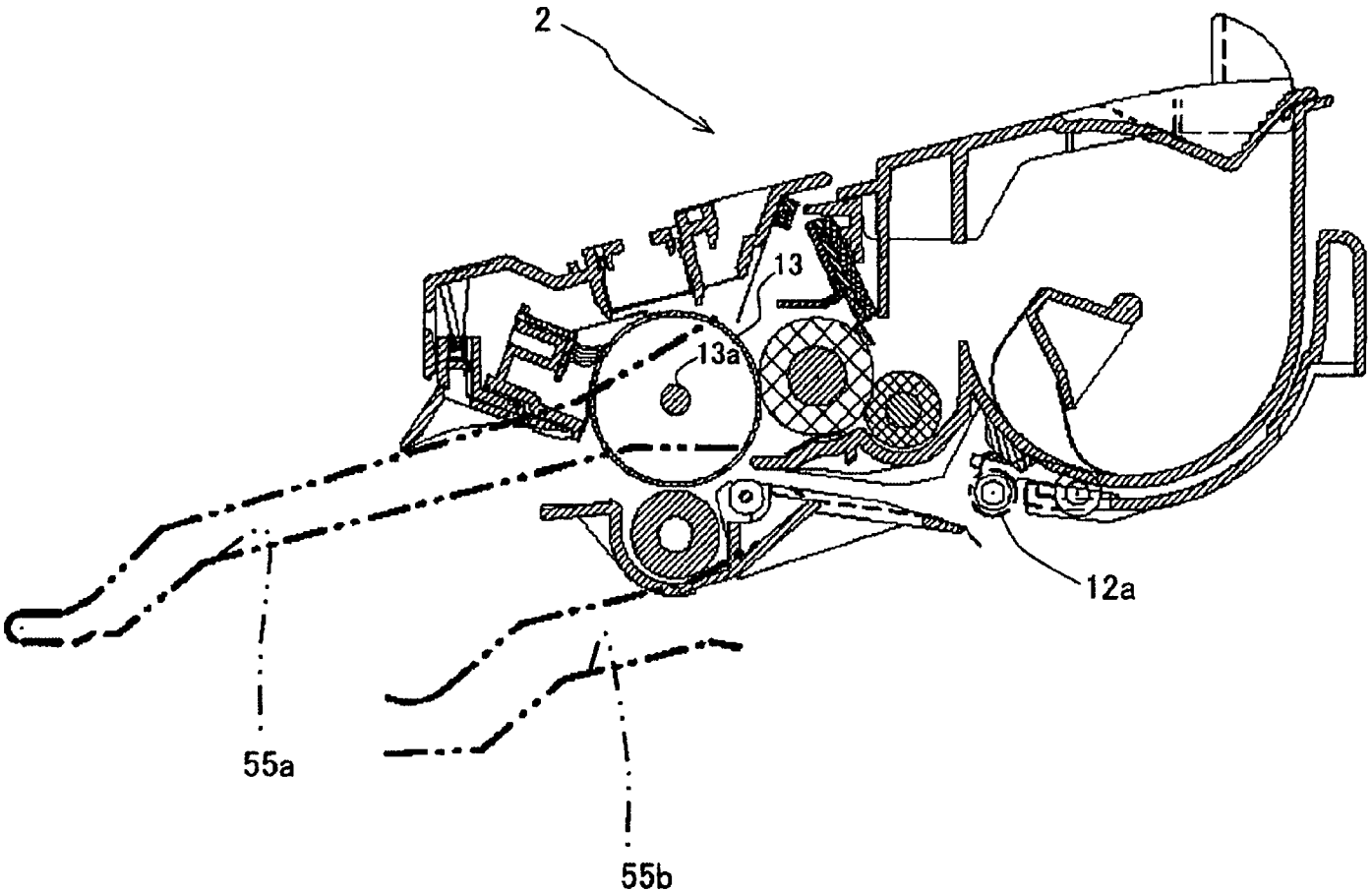
FIG. 18 is a view describing attachment of the process cartridge to a main casing of the laser printer.

As shown in FIG. 18, an upper guiding groove 55*a* and a lower guiding groove 55*b* are formed on an inner surface of each of right and left side plates of the housing 1. The upper guiding groove 55*a* and the lower guiding groove 55*b* extend in substantially parallel to each other and incline downward.

Figure 19:
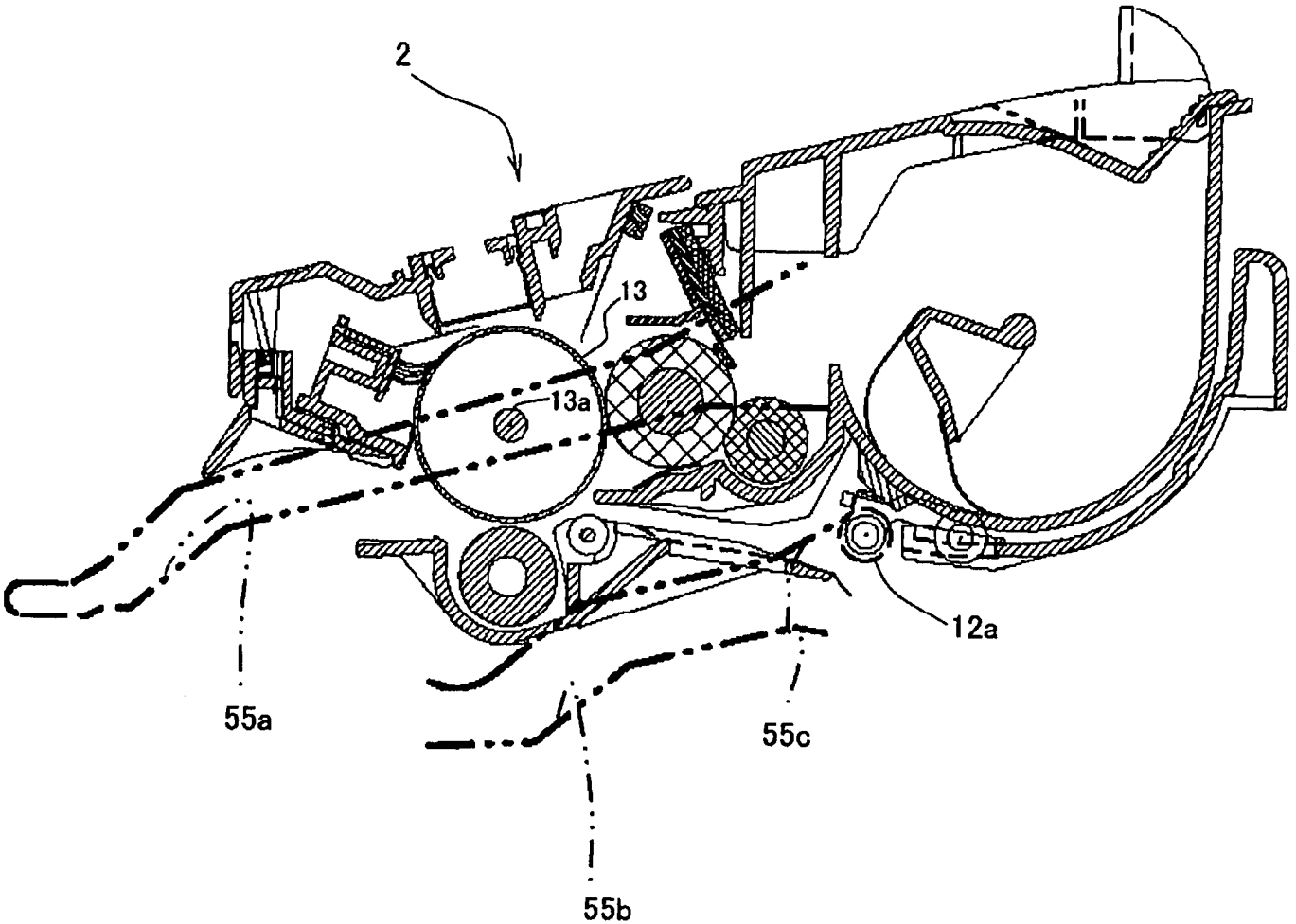
FIG. 19 is a view describing attachment of the process cartridge to the main casing of the laser printer.

FIG. 18 shows the process cartridge 2 located at a start position of insertion into the housing 1. By inserting the process cartridge 2 into the housing 1 from the location shown in FIG. 18, as shown in FIG. 19 the shaft 13*a* of the photosensitive drum 13 is guided along the upper guiding grooves 55*a*, and the upper registration roller 12*a* is guided along the lower guiding grooves 55*b* while contacting upper surfaces 55*c* of the lower guiding grooves 55*b*.

Figure 23:
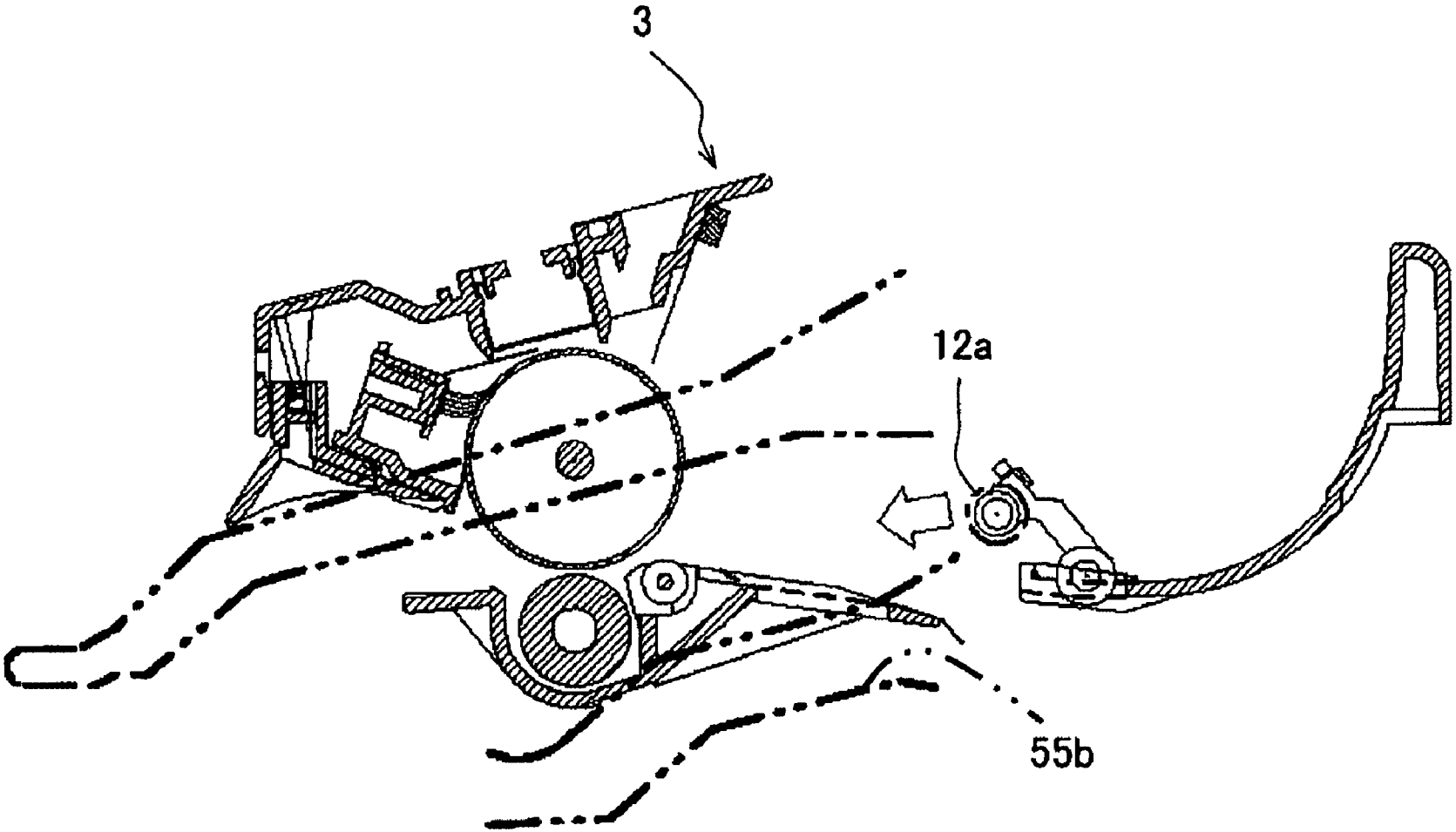
FIG. 23 is a view of a state where the photosensitive-member cartridge alone is mounted to the main casing of the laser printer.

Note that when the user intends to only attach the photosensitive-member cartridge 3 to the housing 1 without the developing cartridge 4 attached to the photosensitive member cartridge 3, as shown in FIG. 23, the upper registration roller 12*a* cannot engage with the lower guiding grooves 55*b* because the upper registration roller 12*a* is retracted to the retract position. Accordingly, the photosensitive-member cartridge 3 alone cannot be attached to the housing 1.

Figure 20:
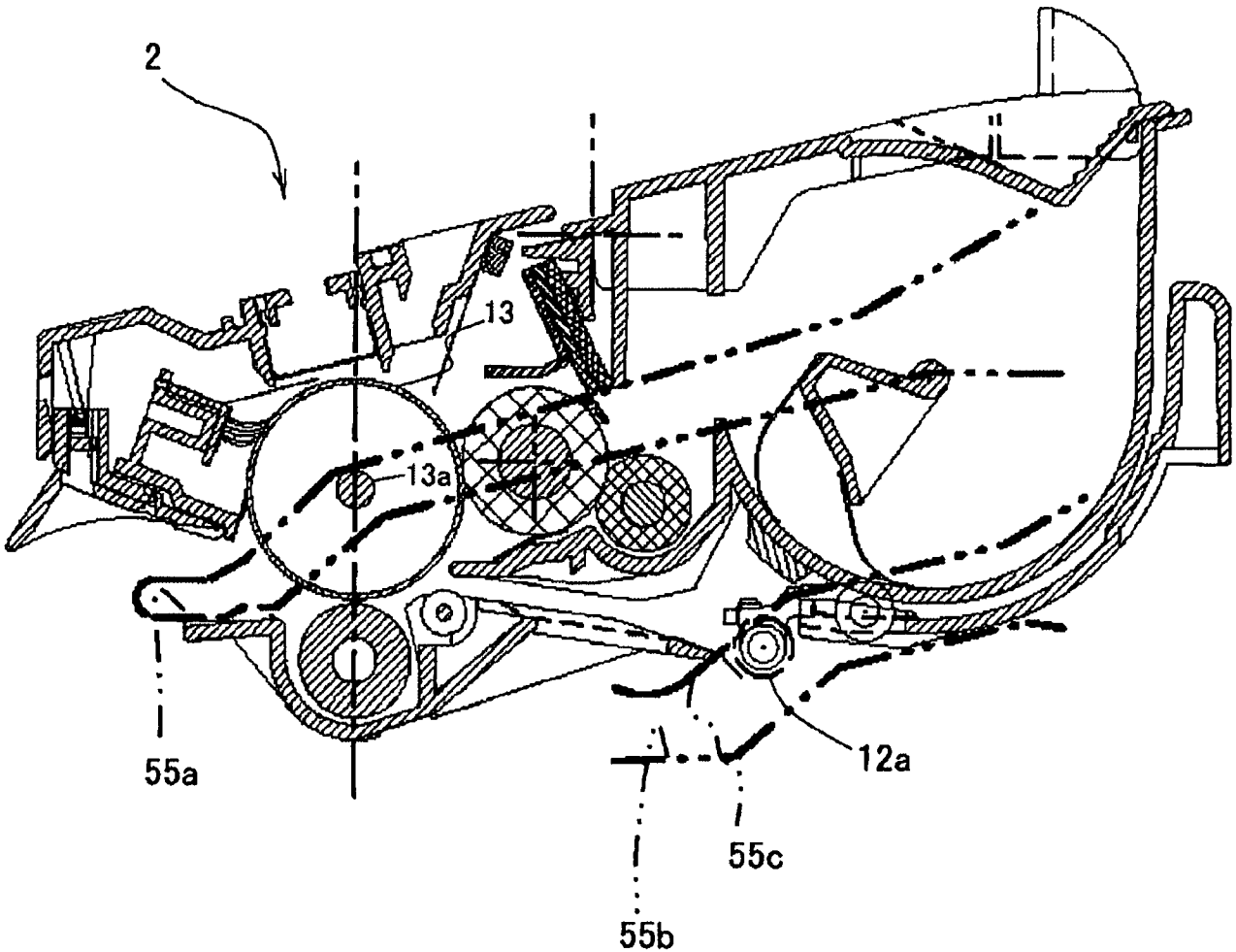
FIG. 20 is a view describing attachment of the process cartridge to the main casing of the laser printer.
Figure 21:
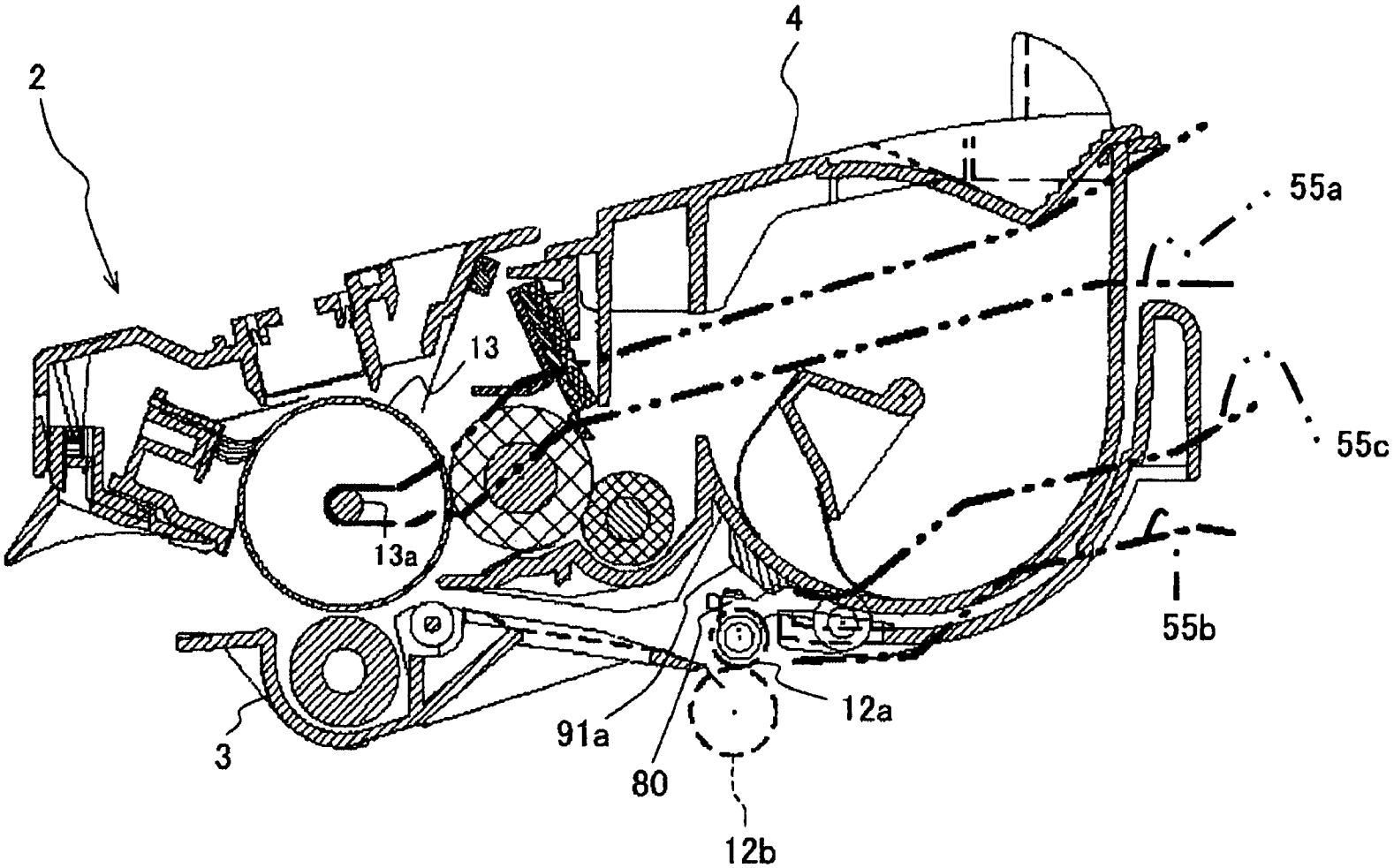
FIG. 21 is a view describing attachment of the process cartridge to the main casing of the laser printer.
Figure 22:
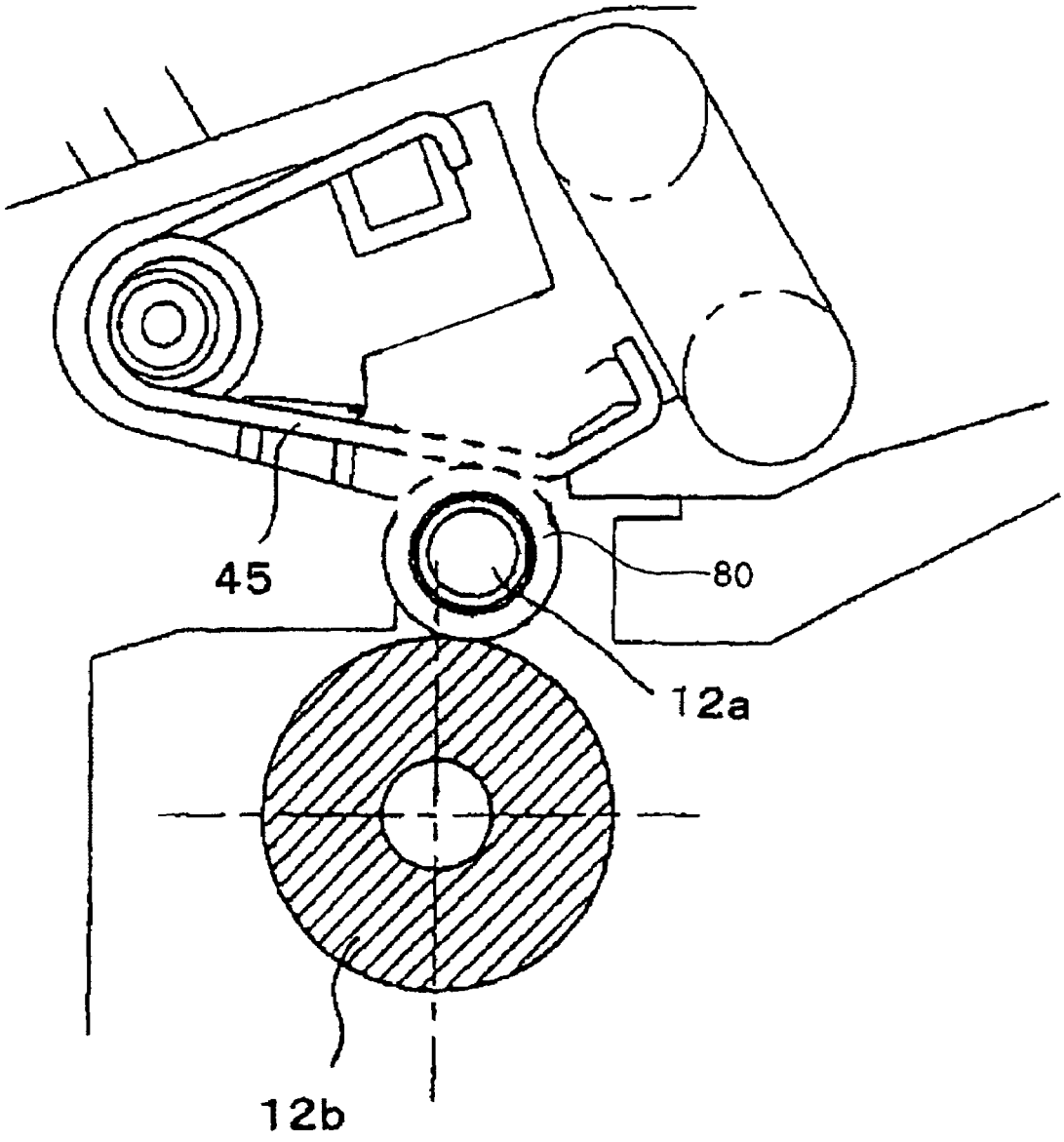
FIG. 22 is a side view of the upper registration roller positioned relative to a lower registration roller when the process cartridge is mounted on the main casing of the laser printer.

When the process cartridge 2 is inserted deeper, the upper registration roller 12*a* moves downward along the upper surface 55*c* of the lower guiding groove 55*b* as shown in FIG. 20. When the shaft 13*a* of the photosensitive drum 13 reaches the deepest ends of the upper guiding grooves 55*a* as shown in FIG. 21, the process cartridge 2 is prevented from further moving inward, and the upper registration roller 12*a* is located off the lower guiding grooves 55*b*. In this state, the upper registration roller 12*a* at the working position opposes the lower registration roller 12*b*. When the user moves his/her hands off the process cartridge 2 in this state, as shown in FIG. 22 the roller support members 80 engage with springs 45 disposed on the side walls of the housing 1. The roller support members 80 attached to the both ends of the upper registration roller 12*a* are pressed downward by the springs 45, and the upper registration roller 12*a* moves to a conveying position below the working position. At the conveying position, the upper registration roller 12*a* opposes the lower registration roller 12*b* and can convey the paper P in cooperation with the lower registration roller 12*b*.

Here, the urging force of the springs 45 urging the upper registration roller 12*a* against the lower registration roller 12*b* is larger than the urging force of the torsion coil springs 90 urging the upper registration roller 12*a* toward the retract position. Therefore, the upper registration roller 12*a* is positioned in pressed contact with the lower registration roller 12*b* at proper position and angle with respect to the lower registration roller 12*b* with proper pressing force. Accordingly, the upper registration roller 12*a* can properly contact the lower registration roller 12*b*, and thus the proper relationship between the upper registration roller 12*a* and the lower registration roller 12*b* can be maintained all the time. As a result, the paper P can be stably conveyed at any time.

As shown in FIG. 21, when the upper registration roller 12*a* is at the conveying position, the pressing parts 91*a* of the developing cartridge 4 separate from the roller support members 80. Consequently, the pressing of the developing cartridge 4 can be prevented from acting on the contact state of the upper registration roller 12*a* with the lower registration roller 12*b*. Therefore, the pressing parts 91*a* of the developing cartridge 4 can be prevented from exerting a harmful influence on the image quality, and deterioration in the image can be prevented.

As described above, according to the illustrative aspects, when the photosensitive-member cartridge 3 is alone, the upper registration roller 12*a* is held at the retract position above the bottom surface of the casing 30. Therefore, the upper registration roller 12*a* does not rattle or protrude beyond the bottom surface of the casing 30 to become an obstacle. Also, when the developing cartridge 4 is attached to the photosensitive-member cartridge 3, the upper registration roller 12*a* is held at the working position. Thus, when handling the photosensitive-member cartridge 3 attached with the developing cartridge 4, the upper registration roller 12*a* does not rattle, thereby facilitating handling.

Since the pair of torsion coil springs 90 urge the respective roller support members 80 that rotatably support the upper registration roller 12*a*, it is possible to urge the upper registration roller 12*a* without needing a complicated urging mechanism. Also, the roller support members 80 and the torsion coil springs 90 do not interrupt conveyance of the paper P.

Further, because the roller support members 80 are used for supporting the upper registration roller 12*a*, the upper registration roller 12*a* can be supported so as to be movable with respect to the casing 30 with a simple configuration.

Since only attachment of the developing cartridge 4 onto the photosensitive-member cartridge 3 presses the upper registration roller 12*a* through the pressing parts 91*a*, a complicated pressing mechanism is unnecessary. Since the pressing parts 91*a* are disposed to oppose the roller support members 80, the pressing parts 91*a* can press the upper registration roller 12*a* uniformly with respect to the longitudinal direction of the roller support members 80 or the upper registration roller 12*a*.

Furthermore, since the pressing parts 91*a* press the upper registration roller 12*a* through the roller support members 80, the pressing parts 91*a* can move the upper registration roller 12*a* without harming the upper registration roller 12*a*.

While the invention has been described in detail with reference to the above aspects thereof, it would be apparent to those skilled in the art that various changes and modifications may be made therein without departing from the spirit of the invention.

Figure 24:
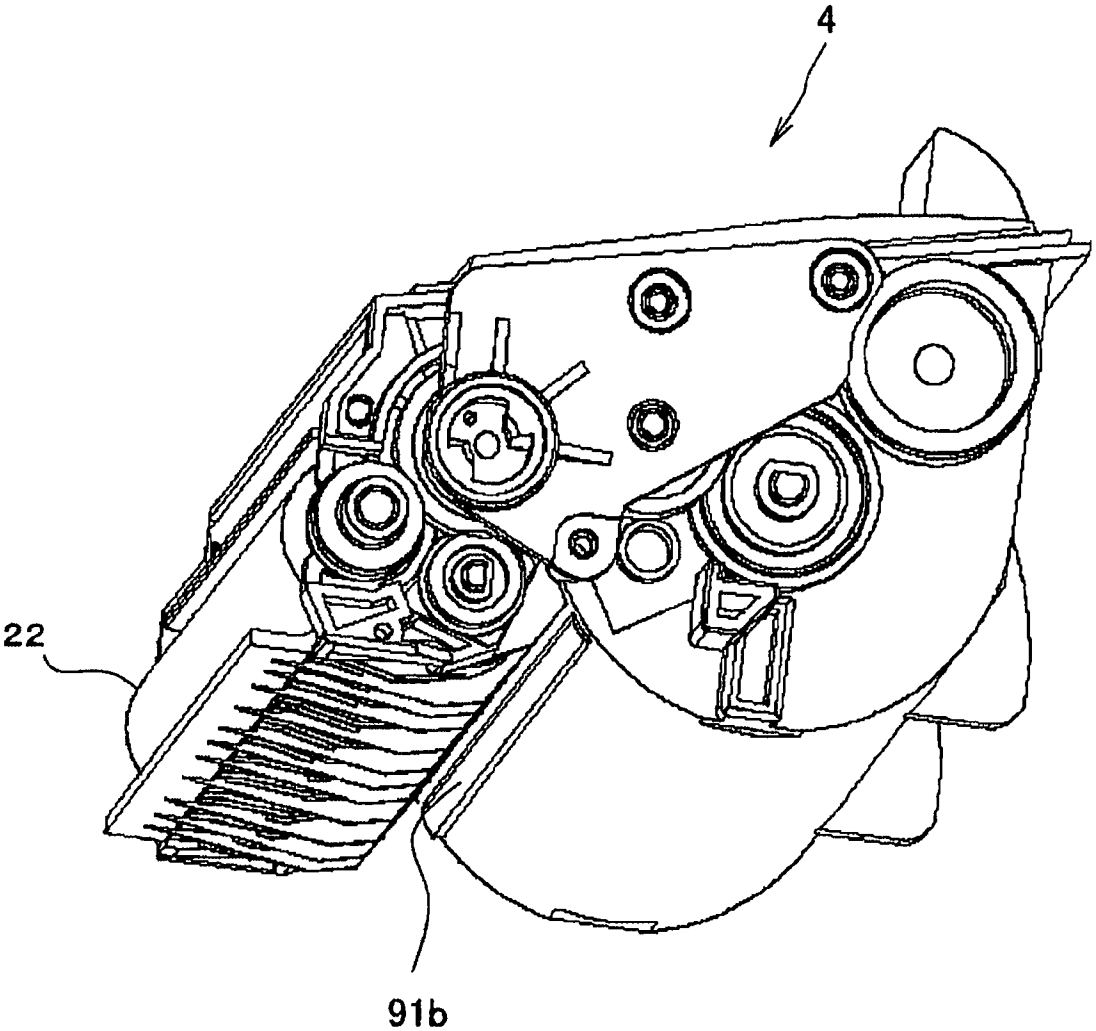
FIG. 24 is a perspective view of a developing cartridge according to a modification of the illustrative aspects from a point diagonally below.
Figure 25:
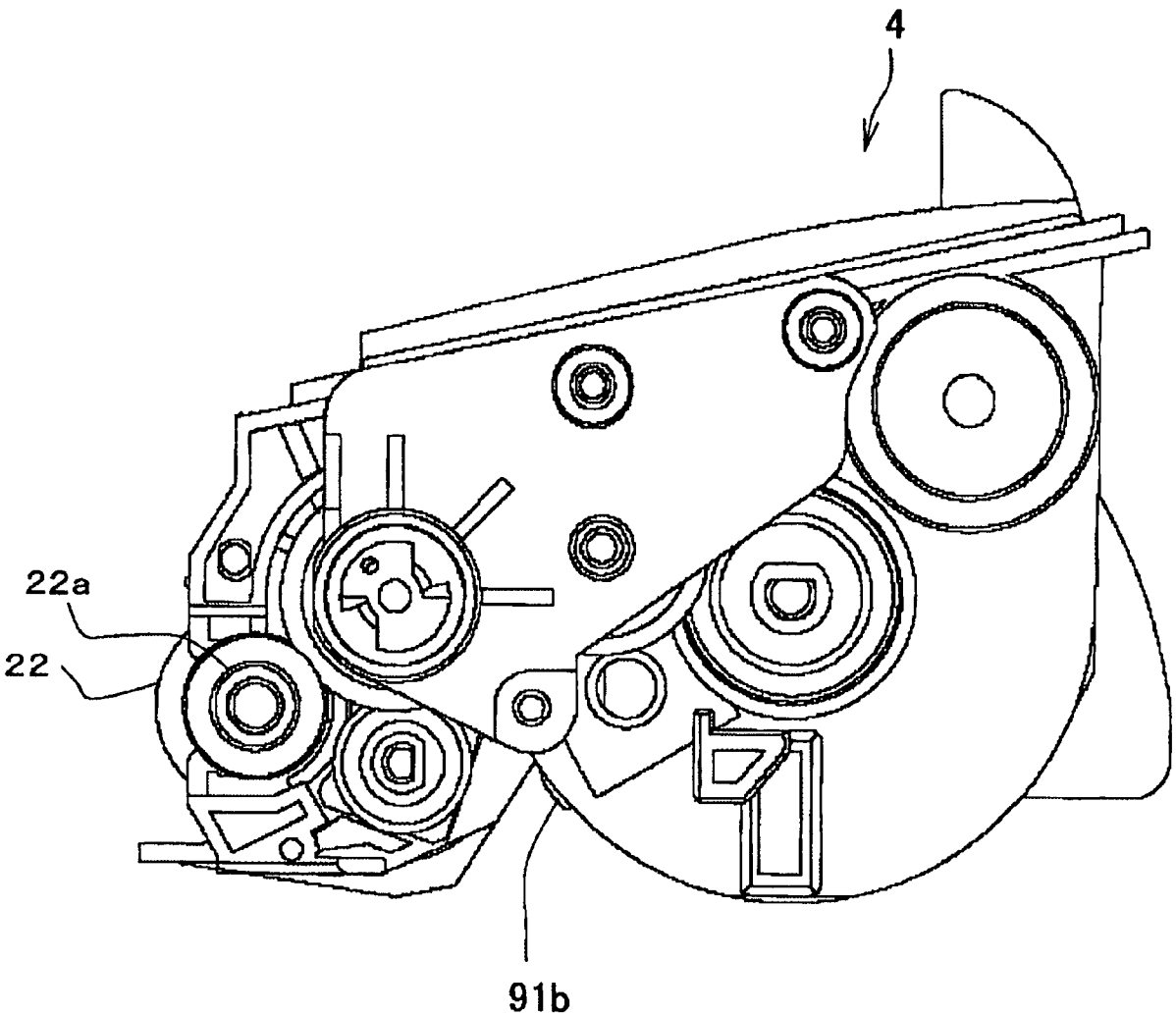
FIG. 25 is a side view of the developing cartridge in FIG. 24.
Figure 26:
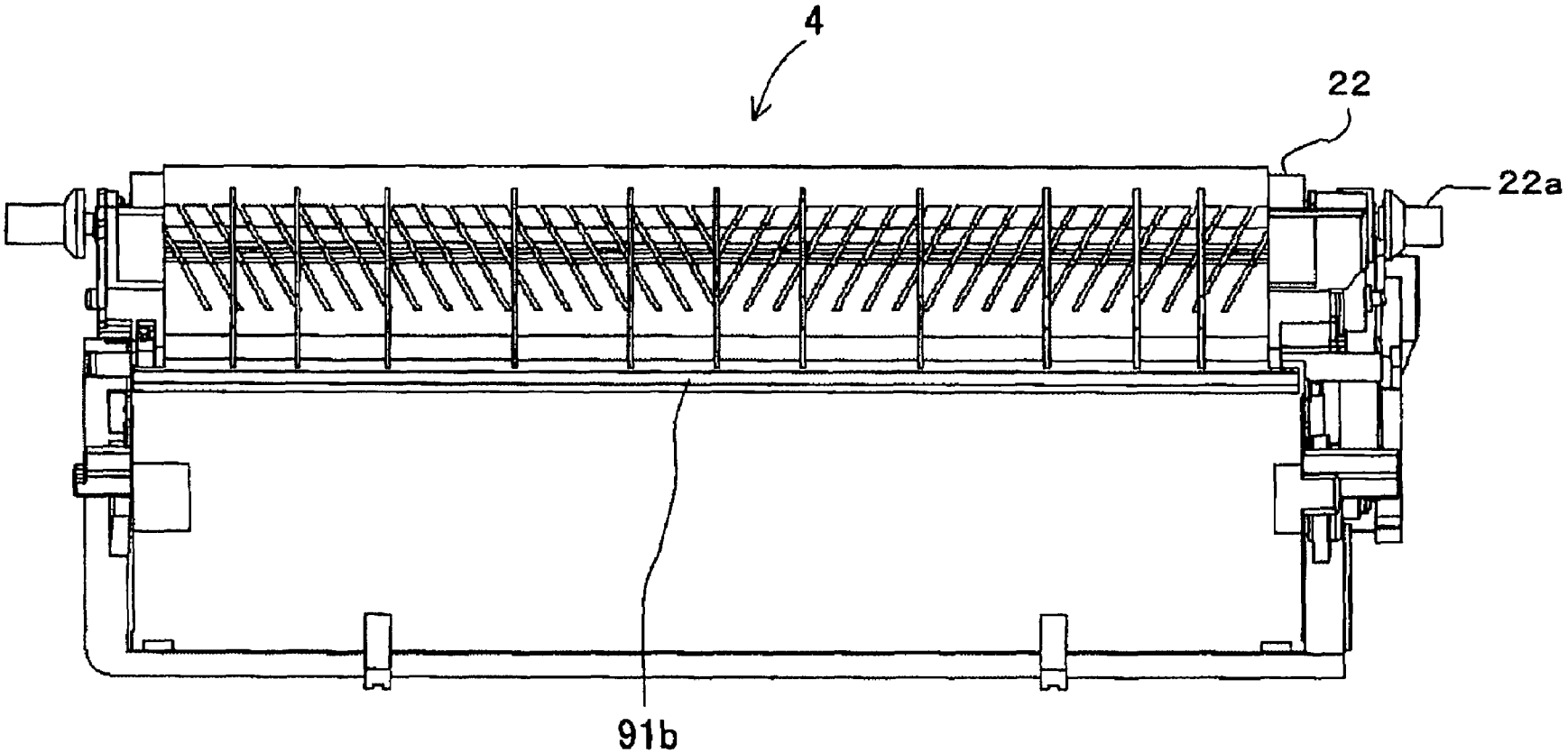
FIG. 26 is a bottom view of the developing cartridge in FIG. 24.

For example, as shown in FIG. 24 to FIG. 26, the developing cartridge 4 may be formed with a pressing part 91*b* instead of the pressing parts 91*a*. Specifically, the pressing part 91*b* protrudes from the bottom surface of the developing cartridge 4 and extends in parallel with the axis of the developing roller 22. The pressing part 91*b* is elongated to contact the engaging members 80*e* of the roller support members 80 on the both ends of the upper registration roller 12*a* when the developing cartridge 4 is attached to the photosensitive-member cartridge 3.

Figure 27:
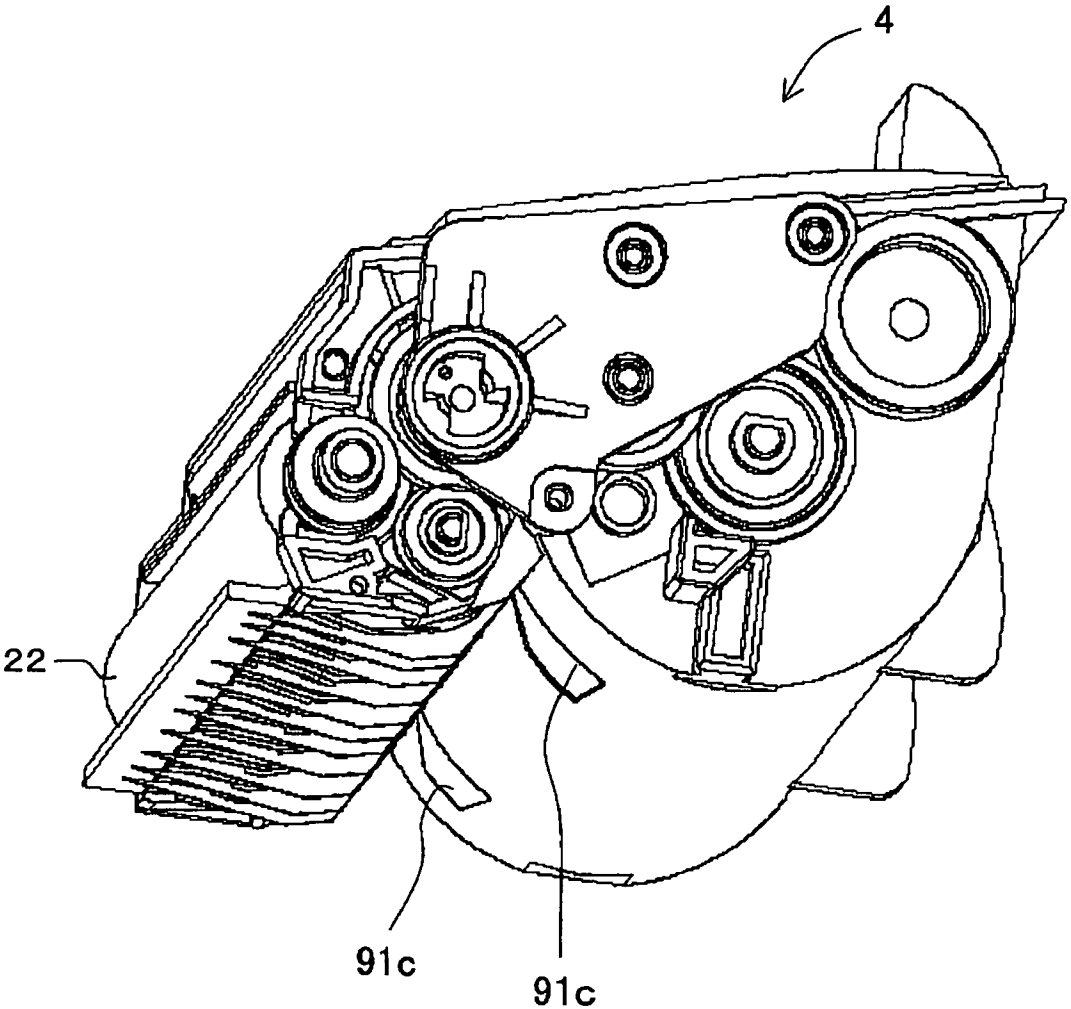
FIG. 27 is a perspective view of a developing cartridge according to another modification of the illustrative aspects, from a point diagonally below.
Figure 28:
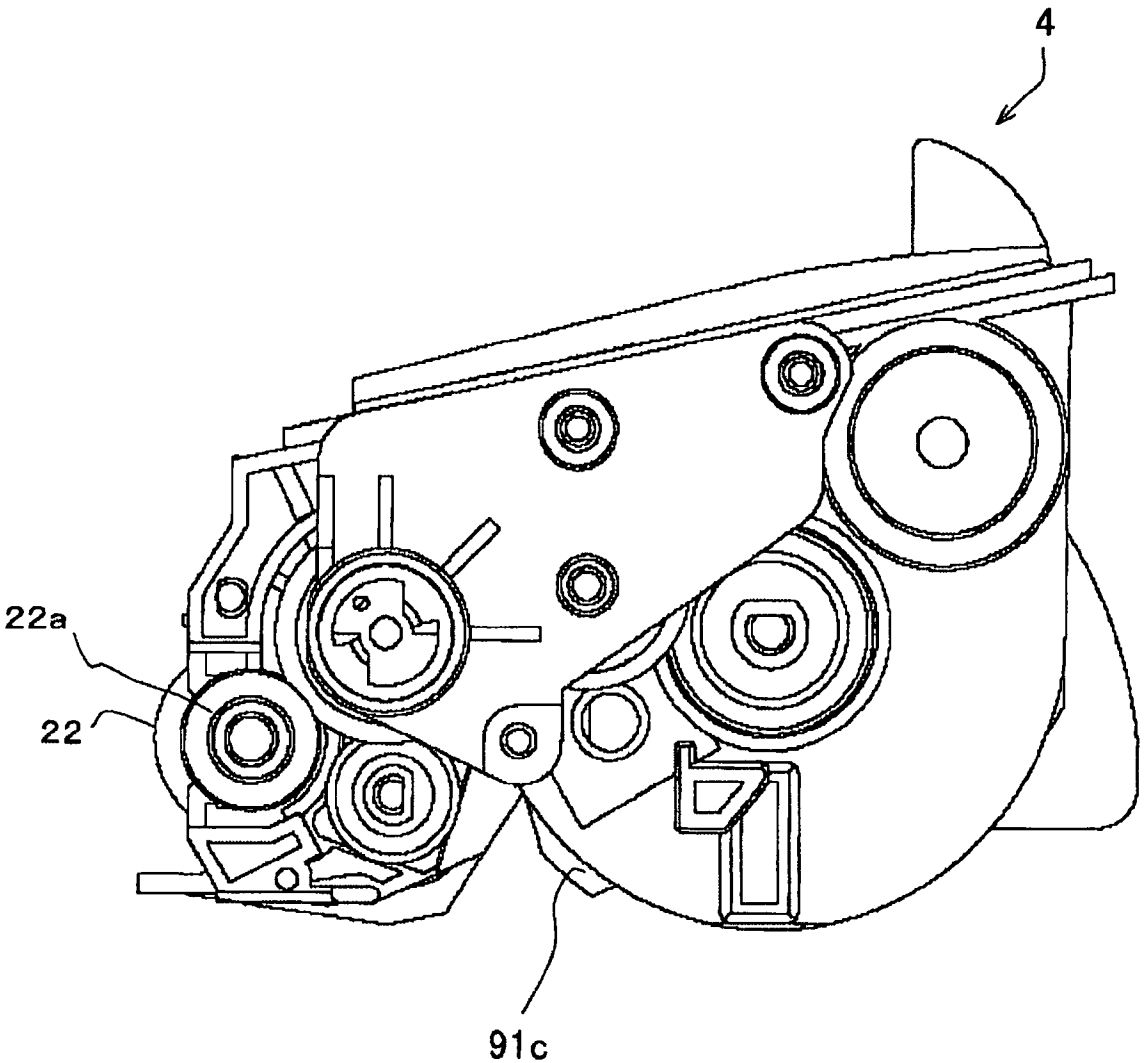
FIG. 28 is a side view of the developing cartridge in FIG. 27.
Figure 29:
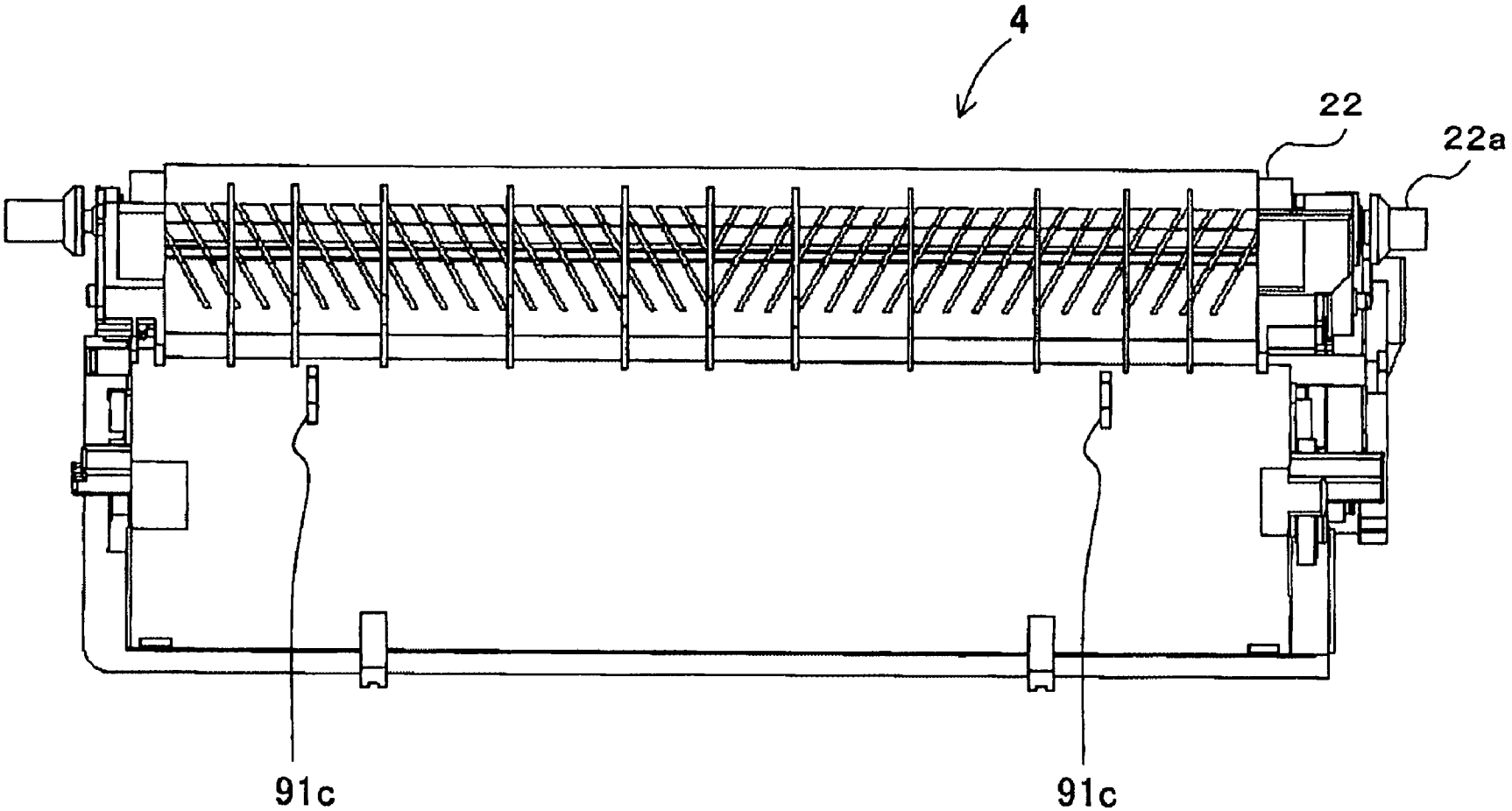
FIG. 29 is a bottom view of the developing cartridge in FIG. 27.

Alternatively, the developing cartridge 4 may be formed with pressing parts 91*c* shown in FIGS. 27 to 29 in place of the pressing parts 91*a*. Specifically, the pressing parts 91*c* protrude from the bottom surface of the developing cartridge 4, at positions opposed to the upper registration roller 12*a* when the developing cartridge 4 is attached to the photosensitive-member cartridge 3. Thus, when the developing cartridge 4 is attached to the photosensitive-member cartridge 3, the pressing parts 91*c* press the upper registration roller 12*a* downward against the urging force of the torsion coil springs 90. With this configuration, since the pressing parts 91*c* directly press the upper registration roller 12*a*, the pressing force of the pressing parts 91*c* can be stably transmitted to the upper registration roller 12*a* to move the upper registration roller 12*a*. Since the pressing parts 91*c* are formed integrally with the casing 4*c* of the developing cartridge 4, the developing cartridge 4 can have a simple configuration.

Also, the above-described pressing parts 91*a* to 91*c* are not necessarily formed integrally with the casing 4*c* of the developing cartridge 4. The pressing parts 91*a* to 91*c* may be formed separate from the casing 4*c* of the developing cartridge 4 and attached to the bottom surface of the casing.

In the above-described aspects, the roller support members 80 shown in FIGS. 3(*a*) to 3(*c*) are used for supporting the upper registration roller 12*a*. However, a different member may be used as long as the member can rotatably support the upper registration roller 12*a* with respect to the casing 30 of the photosensitive-member cartridge 3.

In the above-described aspects, the torsion coil springs 90 shown in FIGS. 3(*d*) and 3(*e*) are used for urging the upper registration roller 12*a*. However, a different spring may be used as long as the spring can urge the upper registration roller 12*a* toward the retract position.

Figure 30:
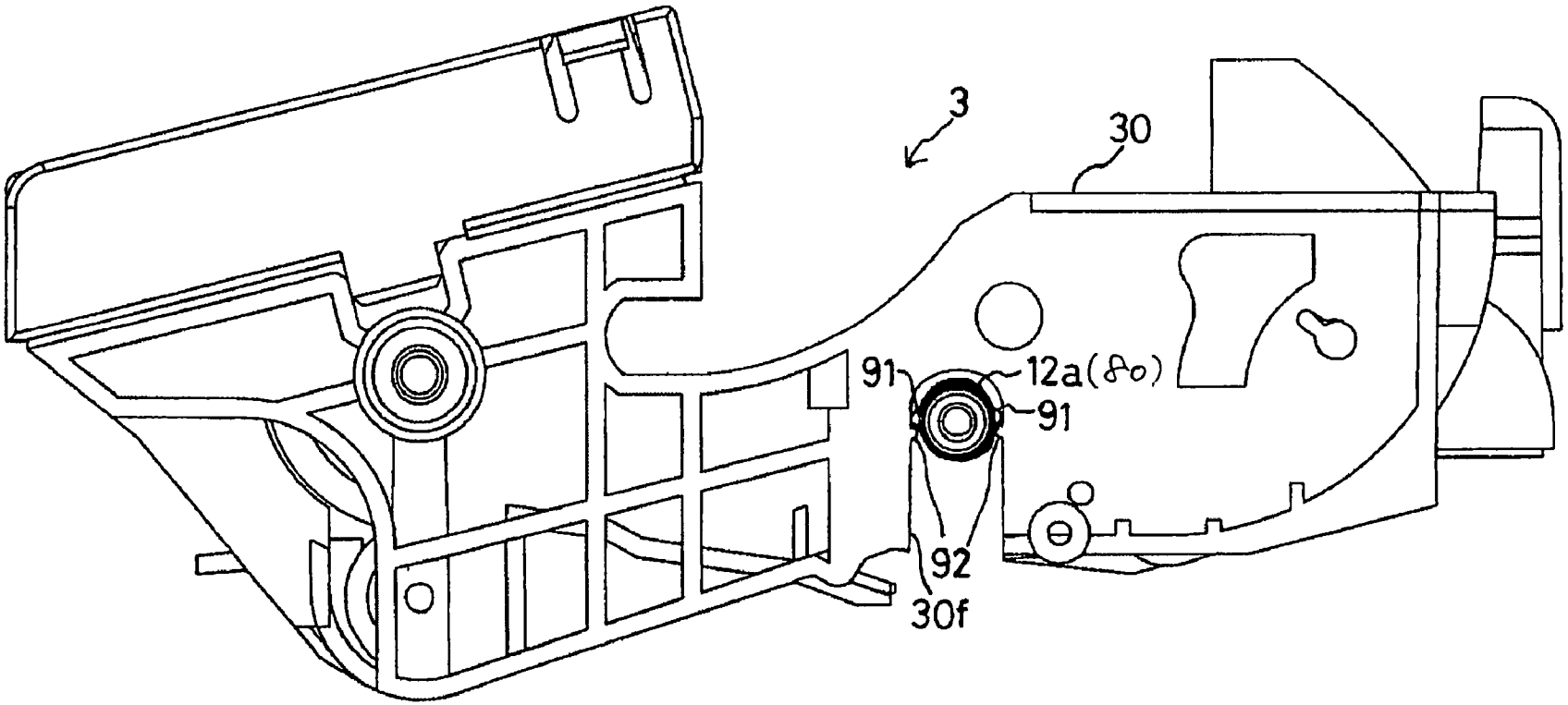
FIG. 30 is a view showing another configuration for positioning the upper registration roller at a retract position with respect to the casing of the photosensitive-member cartridge.

In the above-mentioned aspects, the torsion coil springs 90 are used for holding the upper registration roller 12*a* while preventing the upper registration roller 12*a* from rattling with respect to the casing 30 of the photosensitive-member cartridge 3. However, a different configuration is possible for holding the upper registration roller 12*a* in this manner. For example, as shown in FIG. 30, engaging parts 91 may be formed on circumferential surfaces of the roller support members 80 so as to protrude outward from the circumferential surfaces, and engaged parts 92 may be formed on inner side surfaces of the notch portions 30*f* of the casing 30. With this configuration, the upper registration roller 12*a* is prevented from moving downward by the engaging parts 91 catching on the engaged parts 92, and thus held at the retract position where the upper registration roller 12*a* abuts against the upper edges of the notch portions 30*f* and does not rattle. When the developing cartridge 4 is attached to the photosensitive-member cartridge 3, the developing cartridge 4 presses the upper registration roller 12*a* downward, disengaging the engaging parts 91 from the engaged parts 92. As a result, the upper registration roller 12*a* moves to the working position.

What is claimed is:

1. A photosensitive-member cartridge attachable to an image forming device including a device-side roller, the photosensitive-member cartridge comprising:

a photosensitive member on which an electrostatic latent image is formed;

a casing that houses the photosensitive member, wherein a developing cartridge including a developing member that develops the electrostatic latent image into a visible image is detachably attachable to the casing;

a conveying member including a cartridge-side roller supported on the casing so as to be movable relative to the casing, the cartridge-side roller conveying a recording medium in cooperation with the device-side roller; and a holding member that is disposed between the casing and the conveying member and urges the conveying member to the casing, wherein the holding member prevents the conveying member from rattling relative to the casing, wherein the cartridge-side roller is movable between a first position and a second position outward of the first position with respect to the casing, and the holding member urges the cartridge-side roller toward the first position to prevent the conveying member from rattling relative to the casing.

2. The photosensitive-member cartridge according to claim 1, wherein the conveying member further includes a support member that is rotatably supported on the casing and rotatably supports the cartridge-side roller.

3. The photosensitive-member cartridge according to claim 2, wherein the holding member is a spring the urges the cartridge-side roller.

4. The photosensitive-member cartridge according to claim 2, wherein the conveying member includes a pair of support members that supports both ends of the cartridge-side roller, wherein the holding member includes a pair of springs that urges the cartridge-side roller.

5. The photosensitive-member cartridge according to claim 2, wherein the conveying member includes an engaging part, and when the developing cartridge is attached to the casing, the engaging part engages with the developing cartridge, thereby moving the cartridge-side roller from the first position to the second position.

6. The photosensitive-member cartridge according to claim 5, wherein the engaging part is formed on the support member.

7. A developing cartridge detachably attachable to a photosensitive-member cartridge including: a photosensitive member on which an electrostatic latent image is formed; a casing that houses the photosensitive member; a conveying member including a cartridge-side roller that conveys a recording medium in cooperation with a device-side roller of an image-forming device and a support member that rotatably supports the cartridge-side roller; the cartridge-side roller being movable between a first position and a second position outward of the first position with respect to the casing; and a holding member that urges the cartridge-side roller toward the first position the developing cartridge comprising:

a developing member that develops the electrostatic latent image formed on the photosensitive member of the photosensitive-member cartridge; and a pressing member that presses the cartridge-side roller of the photosensitive-member cartridge against the holding member of the photosensitive-member cartridge when the developing cartridge is attached to the photosensitive-member cartridge.

8. The developing cartridge according to claim 7, wherein when the developing cartridge is attached to the photosensitive-member cartridge, the pressing member presses the conveying member of the photosensitive-member cartridge to move the cartridge-side roller outward with respect to the casing of the photosensitive-member cartridge.

9. The developing cartridge according to claim 7, wherein when the developing cartridge is attached to the photosensitive-member cartridge, the pressing member presses the conveying member of the photosensitive-member cartridge to move the cartridge-side roller to a position where the cartridge-side roller of the photosensitive-member cartridge opposes the device-side roller of the image-forming device when the photosensitive-member cartridge with the developing cartridge attached thereto is attached to the image-forming device.

10. The developing cartridge according to claim 7, wherein when the developing cartridge is attached to the photosensitive-member cartridge, the pressing member presses the cartridge-side roller through the support member of the photosensitive-member cartridge.

11. The developing cartridge according to claim 7, wherein when the developing cartridge is attached to the photosensitive-member cartridge, the pressing member presses the cartridge-side roller of the photosensitive-member cartridge.

12. The developing cartridge according to claim 7, wherein the pressing member is disposed at a position where the pressing member opposes the support member of the photosensitive-member cartridge when the developing cartridge is attached to the photosensitive-member cartridge.

13. The developing cartridge according to claim 7, wherein the pressing member is disposed at a position where the pressing member opposes the cartridge-side roller of the photosensitive-member cartridge when the developing cartridge is attached to the photosensitive-member cartridge.

14. The developing cartridge according to claim 7, wherein the pressing member has protrusions disposed at least at positions to oppose both ends of the conveying member of the photosensitive-member cartridge when the developing cartridge is attached to the photosensitive-member cartridge.

15. The developing cartridge according to claim 13, further comprising a casing, wherein the pressing member is formed integrally with the casing.

16. An image-forming device comprising:

a device-side roller;

a housing that supports the device-side roller;

a photosensitive-member cartridge detachably supported on the housing, the photosensitive-member cartridge including:

a photosensitive member on which an electrostatic latent image is formed;

a cartridge casing that houses the photosensitive member;

a conveying member including a cartridge-side roller and a support member that rotatably supports the cartridge-side roller, the cartridge-side roller conveying a recording medium in cooperation with the device-side roller; and an urging member that urges the cartridge-side roller toward a retract position;

a developing cartridge detachably attached to the photosensitive-member cartridge, the developing cartridge including:

a developing member that develops the electrostatic latent image formed on the photosensitive member into a visible image; and a pressing member that presses the cartridge-side roller against urging force of the urging member when the developing cartridge is attached to the photosensitive-member cartridge and the photosensitive-member cartridge is detached from the housing; and a resilient member that urges the cartridge-side roller against the device-side roller when the photosensitive-member cartridge and the developing cartridge are mounted to the housing, wherein the urging force of the resilient member is greater than the urging force of the urging member.

17. The image forming device according to claim 16, further comprising a guide member that guides the cartridge-side roller toward a conveying position at which the cartridge-side roller conveys a recording medium in cooperation with the device-side roller when the photosensitive-member cartridge and the developing cartridge are mounted to the housing, wherein when the photosensitive-member cartridge and the developing cartridge are mounted to the housing, the resilient member urges the cartridge-side roller against the device-side roller, moving the cartridge-side roller toward the conveying position.

18. The image forming device according to claim 16, wherein when the photosensitive-member cartridge and the developing cartridge are completely mounted onto the housing, the pressing member separates from the conveying member.

* * * * *

UNITED STATES PATENT AND TRADEMARK OFFICE

CERTIFICATE OF CORRECTION

PATENT NO. : 7,639,967 B2
APPLICATION NO. : 11/500357
DATED : December 29, 2009
INVENTOR(S) : Naoya Kamimura It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 235 days.

Signed and Sealed this

Ninth Day of November, 2010

David J. Kappos

David J. Kappos
*Director of the United States Patent and Trademark Office*